US012808371B2

(12) United States Patent
Stephens et al.

(10) Patent No.: US 12,808,371 B2
(45) Date of Patent: Nov. 24, 2026

(54) MONITORING SYSTEM FOR RECIPROCATING PUMPS

(71) Applicant: FMC Technologies, Inc., Houston, TX (US)

(72) Inventors: Amy C. Stephens, Bluff Dale, TX (US); James Cook, Granbury, TX (US); J. Brant White, Stephenville, TX (US)

( * ) Notice: Subject to any disclaimer, the term of this patent is extended or adjusted under 35 U.S.C. 154(b) by 669 days.

(21) Appl. No.: 18/104,722

(22) Filed: Feb. 1, 2023

(65) Prior Publication Data

US 2023/0250817 A1 Aug. 10, 2023

Related U.S. Application Data

(60) Provisional application No. 63/306,609, filed on Feb. 4, 2022.

(51) Int. Cl.
*F04B 49/06* (2006.01)
*F04B 9/02* (2006.01)
(Continued)

(52) U.S. Cl.
CPC ..... *F04B 49/065* (2013.01); *F04B 9/02* (2013.01); *F04B 51/00* (2013.01); *F04B 53/144* (2013.01);
(Continued)

(58) Field of Classification Search
CPC ..... F04B 9/02; F04B 9/045; F04B 49/065; F04B 51/00; F04B 53/14; F04B 53/144;
(Continued)

(56) References Cited

U.S. PATENT DOCUMENTS 3,921,435 A * 11/1975 Howard ..... F04B 53/10 73/40
5,247,873 A 9/1993 Owens et al.
(Continued)

OTHER PUBLICATIONS

Sentry GB-200 Wireless Temperature Monitoring (Year: 2012).*
(Continued)

*Primary Examiner* — Charles G Freay
*Assistant Examiner* — Joseph S. Herrmann
(74) *Attorney, Agent, or Firm* — Henry C. Query, Jr.

(57) ABSTRACT

A monitoring system for reciprocating pump having a plunger connected to a crankshaft by a crosshead and connecting rod assembly. The monitoring system includes a plurality of wireless temperature sensors which each have a temperature probe connected to a sensor head, a plurality of antennas which each have an antenna head configured to communicate wirelessly with a corresponding one of the sensor heads, and a signal processing unit connected to the plurality of antennas. Each temperature probe is positioned in contact with a corresponding crank pin bearing, wrist pin bearing or crosshead bearing. Each sensor head is mounted to the crosshead, and each antenna head is mounted to the pump at a location in which communication is enabled between the antenna head and its corresponding sensor head when the crosshead reaches a first position during each reciprocation of the crosshead. In operation, each antenna head transmits a radar pulse which is reflected by its corresponding sensor head, the reflected pulse is received by the antenna head and communicated to the signal processing unit, and the signal processing unit determines the temperature of the sensor head from the reflected pulse, which temperature is indicative of the temperature of its corresponding monitored bearing.

37 Claims, 15 Drawing Sheets

(51) Int. Cl.
*F04B 51/00* (2006.01)
*F04B 53/14* (2006.01)

(52) U.S. Cl.
CPC ..... *F04B 2201/0603* (2013.01); *F04B 2201/1209* (2013.01)

(58) Field of Classification Search
CPC ..... F04B 53/16; F04B 2201/0603; F04B 2201/0801; F04B 2201/1209; G08B 21/18–187; F04N 2201/0603; F04N 2201/0801; F04N 2201/1209
See application file for complete search history.

(56) References Cited

U.S. PATENT DOCUMENTS 6,964,518 B1 * 11/2005 Jagtøyen ..... G01K 13/08 374/154
7,581,449 B2 9/2009 Miller
7,610,847 B2 * 11/2009 McKelroy ..... F16J 7/00 92/187
8,376,723 B2 * 2/2013 Kugelev ..... F04B 53/147 92/139
2010/0300683 A1 * 12/2010 Looper ..... E21B 47/008 166/250.01
2016/0208794 A1 * 7/2016 Singh ..... F04B 51/00
2017/0114625 A1 4/2017 Norris et al.
2019/0345921 A1 * 11/2019 Beisel ..... F04B 15/02
2021/0198992 A1 * 7/2021 Christinzio ..... E21B 43/26
2021/0199108 A1 * 7/2021 Beisel ..... G01H 1/00
2023/0392592 A1 * 12/2023 Shampine ..... F04B 51/00
2024/0263629 A1 * 8/2024 Li ..... E21B 43/2607

OTHER PUBLICATIONS

Steinar Fossen et al., "Radar Based Sensors—A New Technology for Real-Time, Direct Temperature Monitoring of Crank and Crosshead Bearings of Diesels and Hazardous Media Reciprocating Compressors," Proceedings of the Thirty-Fifth Turbomachinery Symposium, pp. 97-102 (2006).
Jim Townsend et al., "Updating Temperature Monitoring on Reciprocating Compressor Connecting Rods to Improve Reliability," Engineering Science and Technology, an International Journal, pp. 566-573 (Oct. 28, 2015).
Kongsberg Maritime AS, "Sentry GB-200 Wireless Temperature Monitoring" data sheet (date unknown).

* cited by examiner

MONITORING SYSTEM FOR RECIPROCATING PUMPS

This application is based upon and claims the benefit of U.S. Provisional Patent Application No. 63/306,609 filed on Feb. 4, 2022.

BACKGROUND OF THE DISCLOSURE

The present disclosure relates to reciprocating plunger-type pumps used, for example, in the well service industry. In particular, the disclosure relates to a monitoring system for monitoring the condition of certain components in the power end and/or the fluid end of the pump.

Prior art reciprocating pumps for the well service industry, such as frac pumps, typically include a power end having a crankshaft which is driven by an external power source, such as a combustion engine. The pump also includes a fluid end having a plurality of plungers which are connected to the crankshaft through respective crosshead and connecting rod assemblies. The crosshead and connecting rod assemblies convert the rotary motion of the crankshaft into reciprocating motion of the plungers.

An exemplary crosshead and connecting rod assembly may comprise a crosshead which is connected to the plunger and a connecting rod which links the crankshaft to the crosshead. The crosshead is slidably supported between a pair of elongated upper and lower guide plates which are longitudinally aligned with the plunger, and the connecting rod includes a wrist pin on one end which is pivotally connected to the crosshead and a split collar on the other end which is rotatably connected to a corresponding crank pin on the crankshaft.

Prior art pumps, especially high powered frac pumps, usually employ bearings to reduce friction between the wear components of the pump, such as the crosshead, the wrist pin and the crank pin. For example a crosshead bearing, or crosshead slide, may be positioned between the crosshead and each of the upper and lower guide plates, a wrist pin bearing may be positioned between the wrist pin and the crosshead, and a crank pin bearing may be positioned between the crank pin and the split shaft collar. These bearings, which may be referred to herein as "power end bearings", are commonly made of metal, such as brass. In addition, many prior art pumps may include a lubrication system for circulating a lubricant through the power end bearings in order to further reduce friction between the wear components.

Each crosshead is connected to a respective plunger, typically through a pony shaft. Each plunger in turn is slidably received in a corresponding plunger bore in the fluid end. The plunger bore is connected to a cross bore which in turn is connected to both a suction bore and a discharge bore. The suction bore is connected to a suction line which commonly takes the form of a suction manifold positioned below the fluid end housing, and the discharge bore is connected to a discharge line which extends through the fluid end housing. A suction valve mounted in the suction bore permits fluid flow from the suction manifold to the cross bore but prevents fluid flow in the opposite direction, and a discharge valve mounted in the discharge bore permits fluid flow from the cross bore to the outlet bore but prevents fluid flow in the opposite direction.

In normal operation of the pump, fluid enters each suction bore through the suction manifold and flows through the suction valve and into the cross bore. As the plunger advances into the crossbore, the fluid is pressurized, and as the pressure of the fluid in the crossbore reaches the pressure of the fluid in the discharge line, the discharge valve opens and allows the fluid to flow through the discharge bore and into the discharge line. Once the plunger reaches its full stroke, it retreats and causes the pressure in the crossbore to drop. This allows the discharge valve to close and the suction valve to open, once again filling the crossbore with fluid from the suction manifold. As each plunger is driven by rotation of the crankshaft (through its respective connecting rod, crosshead and pony shaft), this advancing/retreating cycle is repeated to create a continuous flow of fluid from the suction manifold through the discharge line.

During operation of high powered reciprocating pumps, some of the power end and fluid end components discussed above may be subject to failure. For example, the power end bearings can overheat to the extent that they fail, and such failures can often result in damage to the crosshead, the connecting rod and/or the crank pin, a failure of any of which can lead to a failure of the entire power end. In addition, a failure of the relatively inexpensive suction and discharge valves can quickly cause failures to larger, more expensive components within the pump.

Some prior art reciprocating pumps are provided with systems for monitoring the conditions of the wear components in the power end. These monitoring systems may measure, e.g., the temperature of the bearing lubricant as it exits the pump, the pressure of the lubricant at different locations in the pump, and/or vibrations in certain parts of the pump. However, these are indirect measurements of the conditions of the power end components. Most often, when these measurements indicate that a problem exists with one or more of the power end components, the components have typically already failed. Thus, current methods of monitoring the condition of the power end components are insufficient to detect a failure before significant damage has occurred.

Prior art reciprocating pumps may also include systems for monitoring the functionality of the suction and discharge valves. Such systems typically employ pressure sensors to monitor the pressure of the fluid in the discharge line and/or the crossbores. However, when monitoring in these locations, the pressure sensors are subject to high pressures, corrosive fluids, and abrasive solids, which could damage the sensors and lead to faulty pressure readings. Also, the sensors are at risk of accidental damage when regular maintenance is being performed on the fluid end. In addition, the life of a fluid end is substantially shorter than the life of the power end, and when replacing the fluid end, any associated sensors must be replaced or reinstalled on the new fluid end. Thus, current methods of monitoring the conditions of the suction and discharge valves are relatively unreliable and inconvenient.

SUMMARY OF THE DISCLOSURE

In accordance with the present invention, a monitoring system is provided for monitoring the condition of the power end components and/or the fluid end components, namely, the suction and discharge valves. The power end monitoring system relies on the direct measurement of the temperatures of certain power end bearings (such as the crosshead slides, the wrist pin bearing and the crank pin bearing) to provide an indication of the conditions of the bearings. Should the temperature of any of these bearings approach certain predetermined limits, the power end monitoring system can provide a warning so that the issue can be addressed before the bearings fail, thereby enabling more severe damage to the other power end components to be prevented.

The valve monitoring system of the present disclosure relies on measurement of the rod load to provide an indication of failure of a suction or discharge valve. The rod load can be measured by a rod load sensor mounted in the power end of the pump, such as between the pony shaft and the plunger. Thus, the valve monitoring system does not require the use of pressure sensors in the fluid end to monitor the condition of the suction and discharge valves. As a result, the fluid end does not need to be provided with potentially problematic mounting holes for the pressure sensors. In addition, should the fluid end need replacing, the valve monitoring system can remain in place on the power end, thereby eliminating the need to reinstall pressure sensors on the new fluid end.

These and other objects and advantages of the present disclosure will be made apparent from the following detailed description, with reference to the accompanying drawings. In the drawings, the same reference numbers are used to denote similar components in the various embodiments.

DETAILED DESCRIPTION

Figure 1:
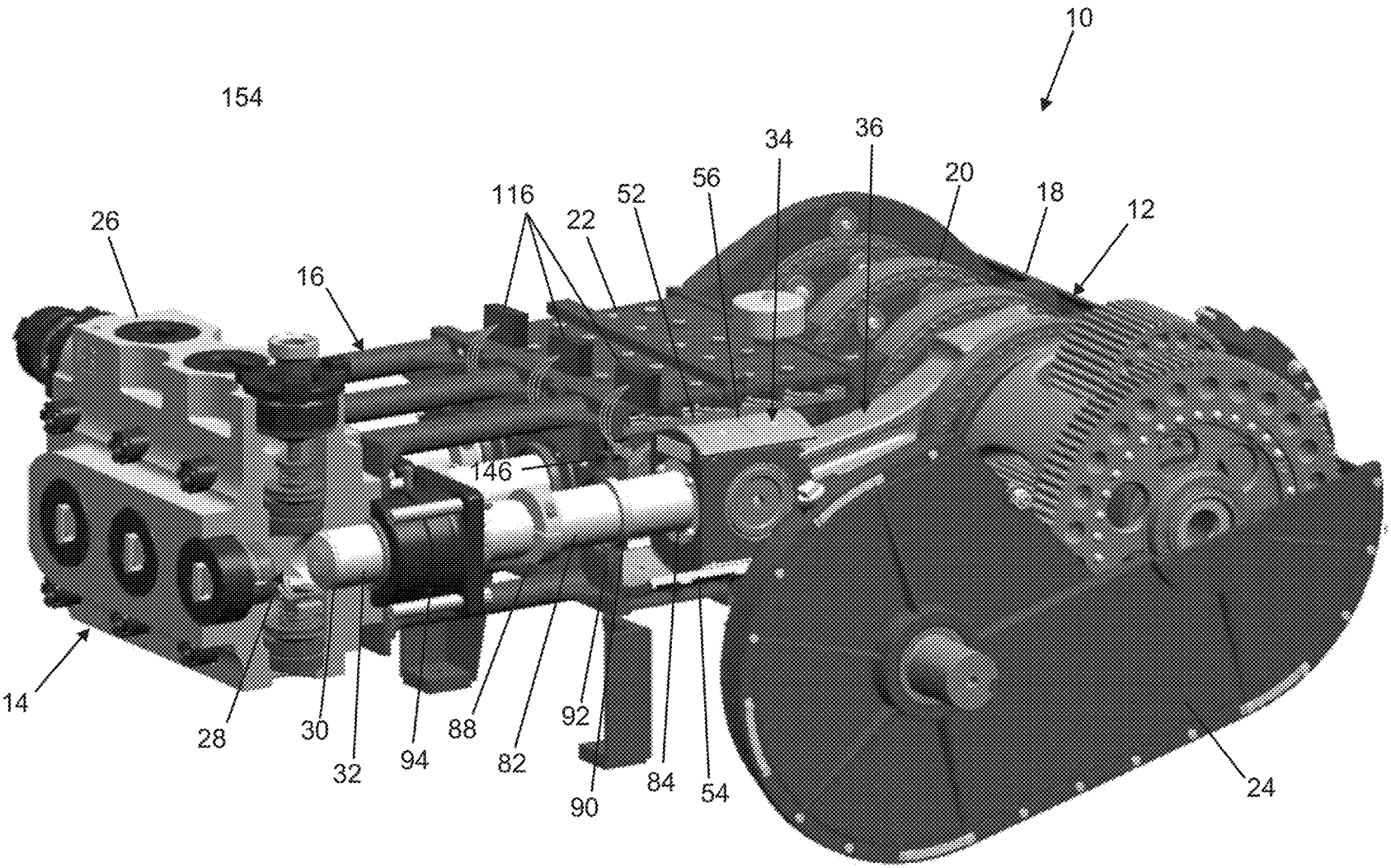
FIG. 1 is a perspective, partial cut-away view of an illustrative plunger pump which includes an embodiment of the condition monitoring system of the present disclosure.
Figure 2:
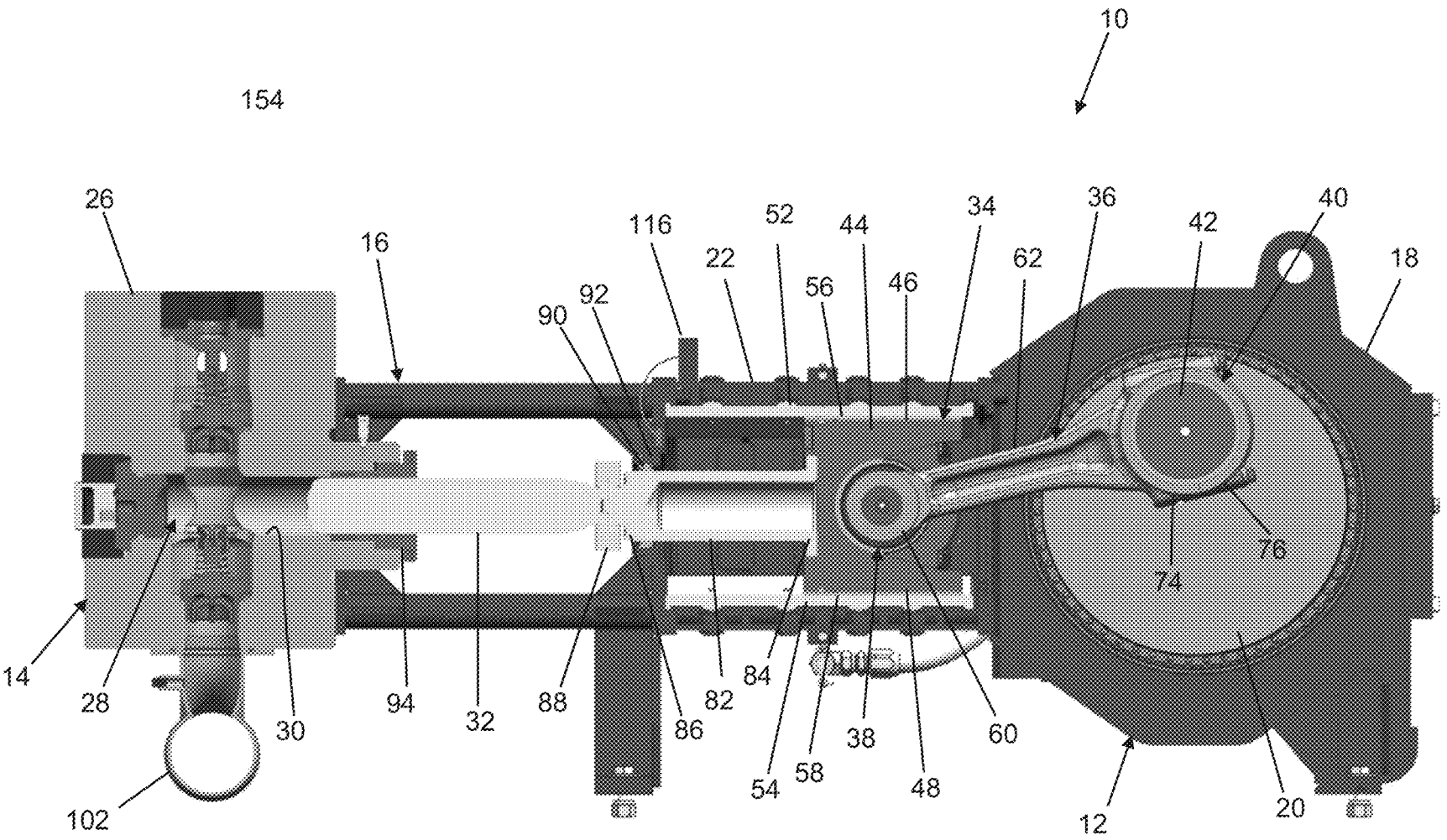
FIG. 2 is a longitudinal cross sectional view of the plunger pump shown in FIG. 1.

An example of a reciprocating plunger pump in connection with which the monitoring system of the present disclosure may be used is shown in FIGS. 1 and 2. The pump of this embodiment, indicated generally by reference number 10, includes a power end assembly 12 and a fluid end assembly 14 connected together by a spacer frame 16. The power end assembly 12 includes a power end housing 18 within which a crankshaft 20 is rotatably supported and a crank housing 22 which is connected between the power end housing 18 and the spacer frame 16. The crankshaft 20 is connected to a gearbox 24 which in turn is connected to a suitable power source (not shown), such as a combustion engine.

The fluid end assembly 14 includes a fluid end housing 26 having a number of spaced apart pumping chambers 28 (only one of which is visible in FIGS. 1 and 2). In the present example, the fluid end housing 26 includes three pumping chambers 28, although in other embodiments the fluid end housing may comprise more or fewer pumping chambers. Each pumping chamber 28 is connected to a corresponding plunger bore 30 within which an associated plunger 32 is reciprocally received.

Each plunger 32 is connected to the crankshaft 20 by a respective crosshead and connecting rod assembly. Each crosshead and connecting rod assembly includes a crosshead 34 which is slidably supported in the crank housing 22 and a connecting rod 36 having a first end 38 which is pivotally connected to the crosshead and a second end 40 which is rotationally connected to a respective crank pin 42 on the crankshaft 20. In operation of the pump 10, rotary motion of the crankshaft 20 is converted by the cross head and connecting rod assembly into linear reciprocating motion of the crosshead 34. The crosshead 34 may be connected to its corresponding plunger 32 by a conventional pony shaft (described more fully below). Thus, the reciprocating motion of the crosshead 34 is transmitted to the plunger 32 to cause the plunger to reciprocate within its plunger bore 30.

Figure 3:
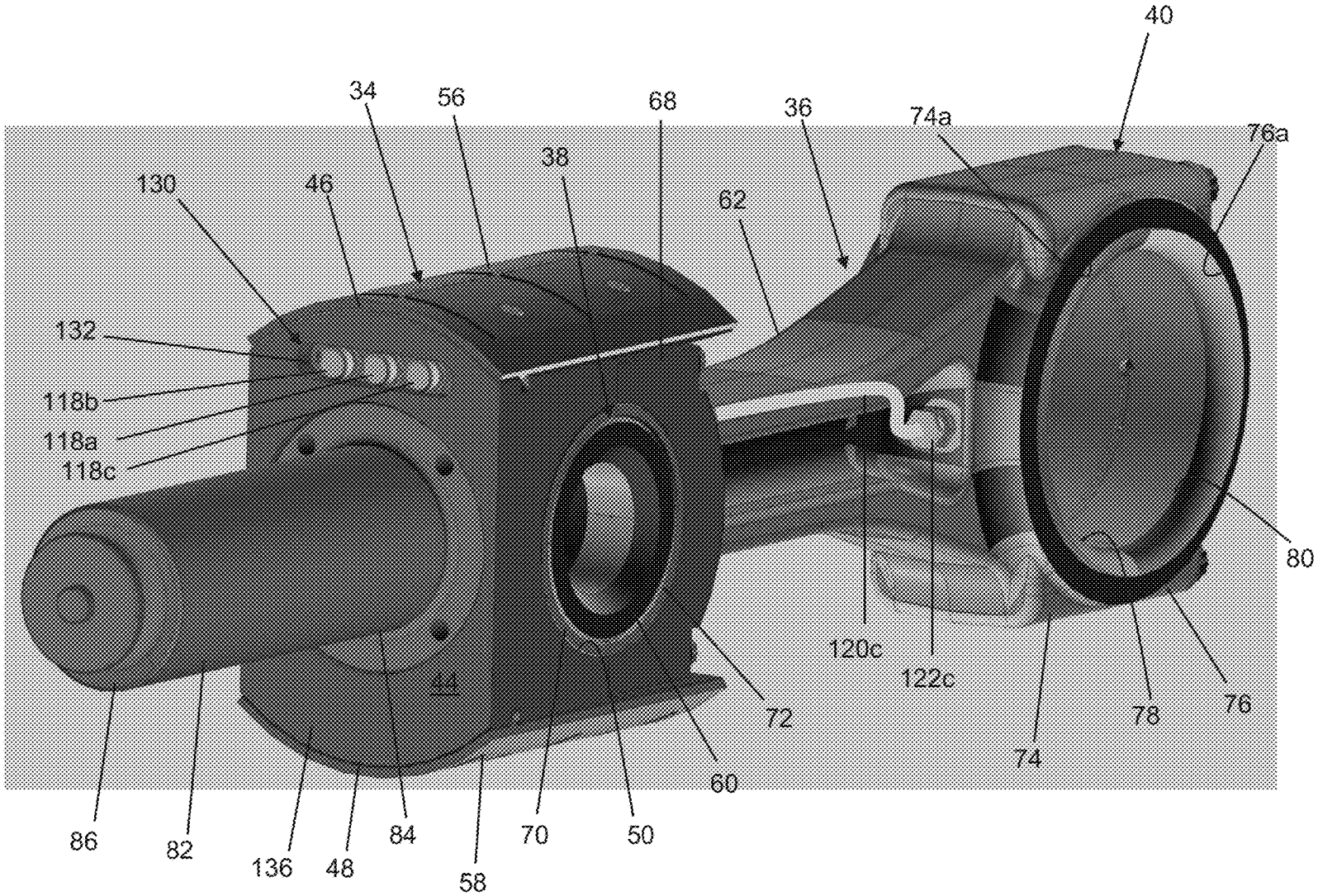
FIG. 3 is a front perspective view of the crosshead and connecting rod assembly of the plunger pump shown in FIGS. 1 and 2.
Figure 4:
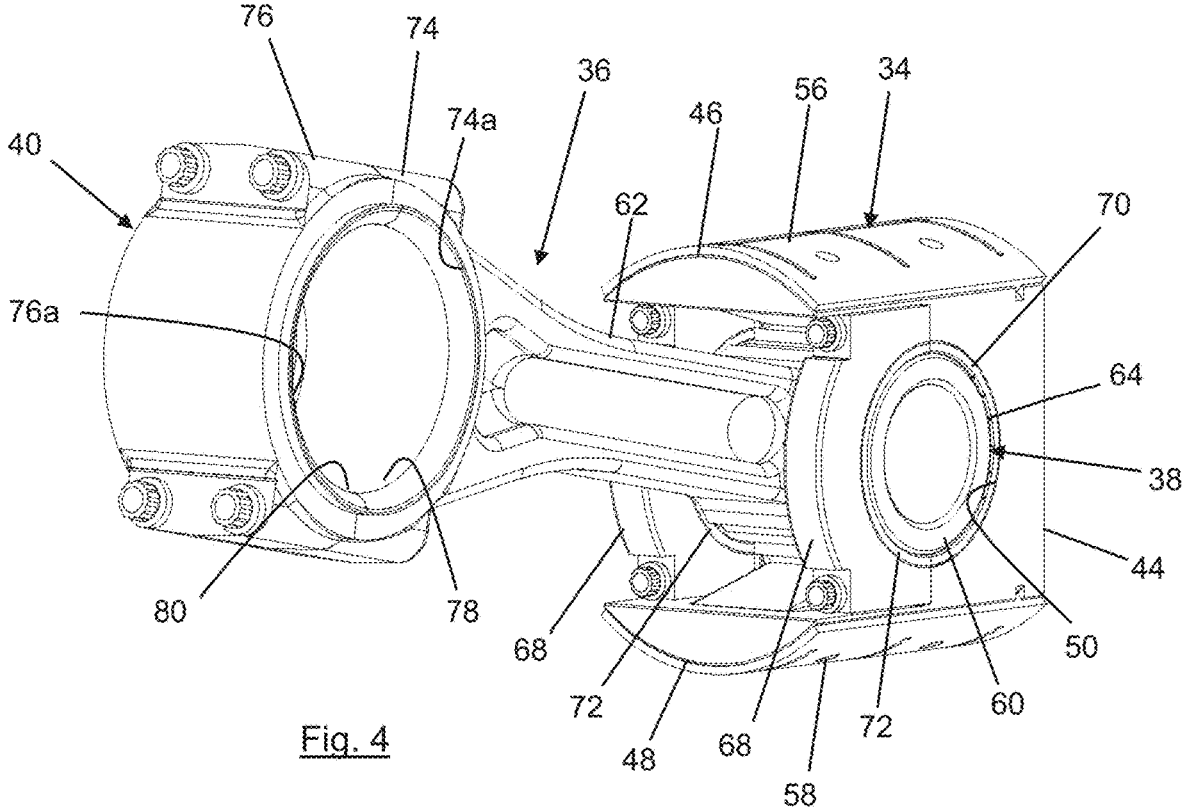
FIG. 4 is a rear perspective view of the crosshead and connecting rod assembly shown in FIG. 3.
Figure 5:
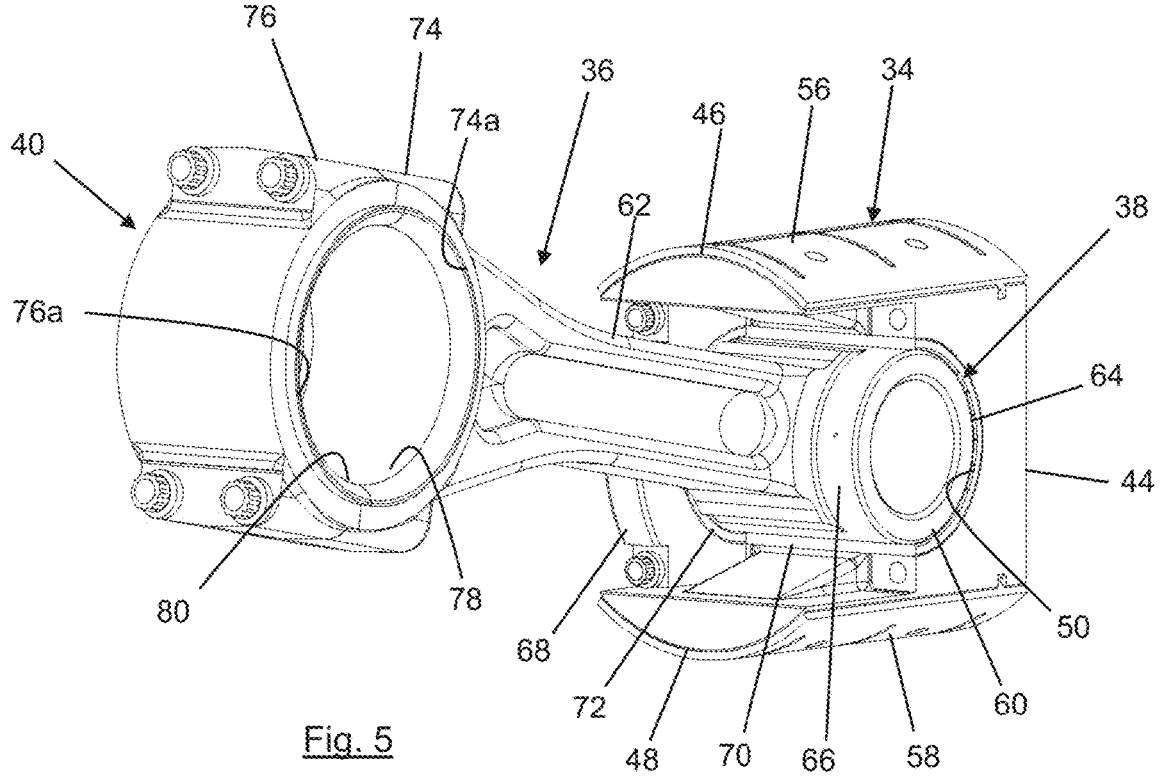
FIG. 5 is a rear perspective view of the crosshead and connecting rod assembly similar to FIG. 4, but with one of the bearing caps removed to provide a clearer view of the interface between the connecting rod and the crosshead.

Referring also to FIGS. 3-5, each crosshead 34 includes a body portion 44 having elongated top and bottom convex surfaces 46, 48, and a transverse semi-cylindrical recess 50 located approximately midway between the top and bottom surfaces. As shown in FIGS. 1 and 2, the body portion 44 is slidably supported between opposing first and second elongated crosshead guide surfaces. In the example shown in the drawings, the opposing elongated crosshead guide surfaces are configured as elongated upper and lower crosshead guides 52, 54. In one embodiment, the crosshead guides may be configured as arcuate guide plates 52, 54 which are bolted to the crank housing 22. In this example, the guide plates 52, 54 comprise opposing concave cross sections which are configured to conform to the top and bottom surfaces 46, 48, respectively, of the crosshead body 44. In this manner, the guide plates 52, 54 restrict lateral movement of the crosshead 34 relative to the crank housing 22. In other embodiments, the opposing elongated crosshead guide surfaces may be defined by the inner surface of a single crosshead guide cylinder.

The crosshead 34 also includes a pair of elongated upper and lower arcuate crosshead bearings, or crosshead slides, 56, 58 mounted to the top and bottom surfaces 46, 48, respectively. The crosshead bearings 56, 58 serve to reduce friction between the top and bottom surfaces 46, 48 and the first and second elongated crosshead guide surfaces (which in this example are defined by the guide plates 52, 54) during operation of the pump 10 and may be made of, e.g., a suitable metal material, such as brass.

The first end 38 of the connecting rod 36 is configured as a transverse thrust cylinder, or wrist pin, 60 which is connected to the second end 40 by an elongated shaft 62. The thrust cylinder 60 defines a semi-cylindrical thrust surface 64 opposite the shaft 62 (see also FIG. 14) and two semi-circular trunnion surfaces 66 on opposite sides of the shaft (only one of which is visible in FIG. 5). The thrust cylinder 60 is received in the semi-cylindrical recess 50 in the body portion 44 of the crosshead 34 and is rotatably retained therein by a pair of bearing caps 68, each of which is bolted to the body portion 44 over a respective trunnion surface 66. As shown best in FIGS. 4, 5 and 14, a semi-cylindrical thrust bushing, or wrist pin bearing, 70 is positioned between the thrust surface 64 and the recess 50, and a semi-cylindrical trunnion bushing 72 is positioned between each trunnion surface 66 and its corresponding bearing cap 68. The bushings 70, 72 function to reduce friction between the thrust cylinder 60 and the crosshead 34 during operation of the pump 10 and may be made, e.g., of a suitable metal material, such as brass.

In other embodiments, the recess may have a configuration other than semi-cylindrical, for instance spherical. In these embodiments, the wrist pin 60 and the wrist pin bearing 70 would have a similar configuration. Also, in embodiments in which the wrist pin 60 is cylindrical, the wrist pin bearing 70 may be configured as two cylindrical bearings, one positioned on each side of the shaft. In this embodiment, the trunnion bearings 72 may not be necessary.

The second end 40 of the connecting rod 36 is configured as a split collar having a first collar half 74 which is connected to the shaft 62 and a second collar half 76 which is bolted to the first collar half. Each collar half 74, 76 includes an inner semi-cylindrical surface 74*a*, 76*a* which is configured to conform to the cylindrical surface of the crank pin 42. During assembly, the first and second collar halves 74, 76 are bolted onto the crank pin 42 to rotationally secure the second end 40 of the connecting rod 36 to the crank shaft 20. As shown best in FIGS. 3-5, the connecting rod 36 may include first and second semi-cylindrical bushings, or crank pin bearings, 78, 80 positioned between the crank pin 42 and the first and second collar halves 74, 76, respectively. The bushings 78, 80 serve to reduce friction between the crank pin 42 and the collar halves 74, 76 during operation of the pump 10 and may be made, e.g., of a suitable metal material, such as brass.

Figure 9:
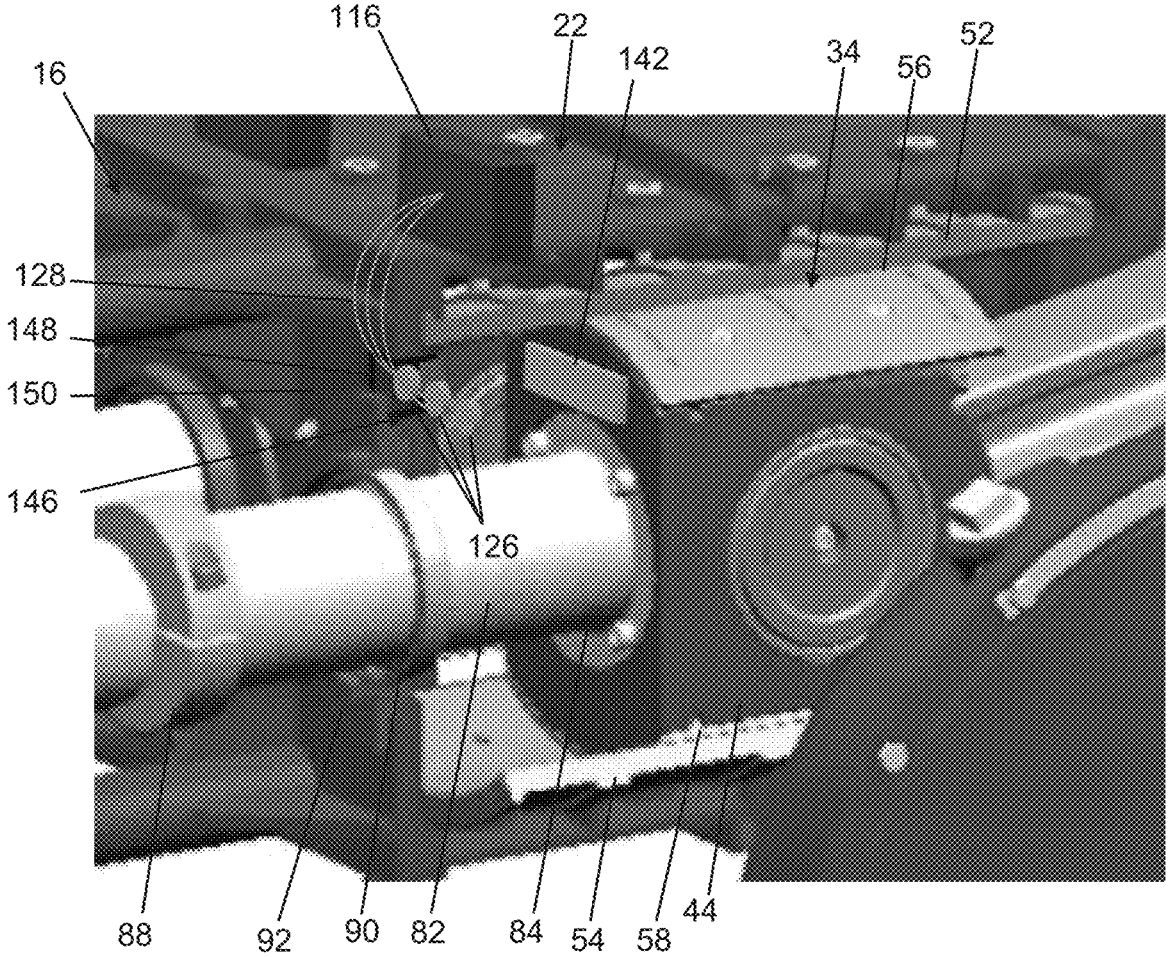
FIG. 9 is an enlarged view of a portion of FIG. 1 showing the crosshead and surrounding components of the present disclosure.
Figure 10:
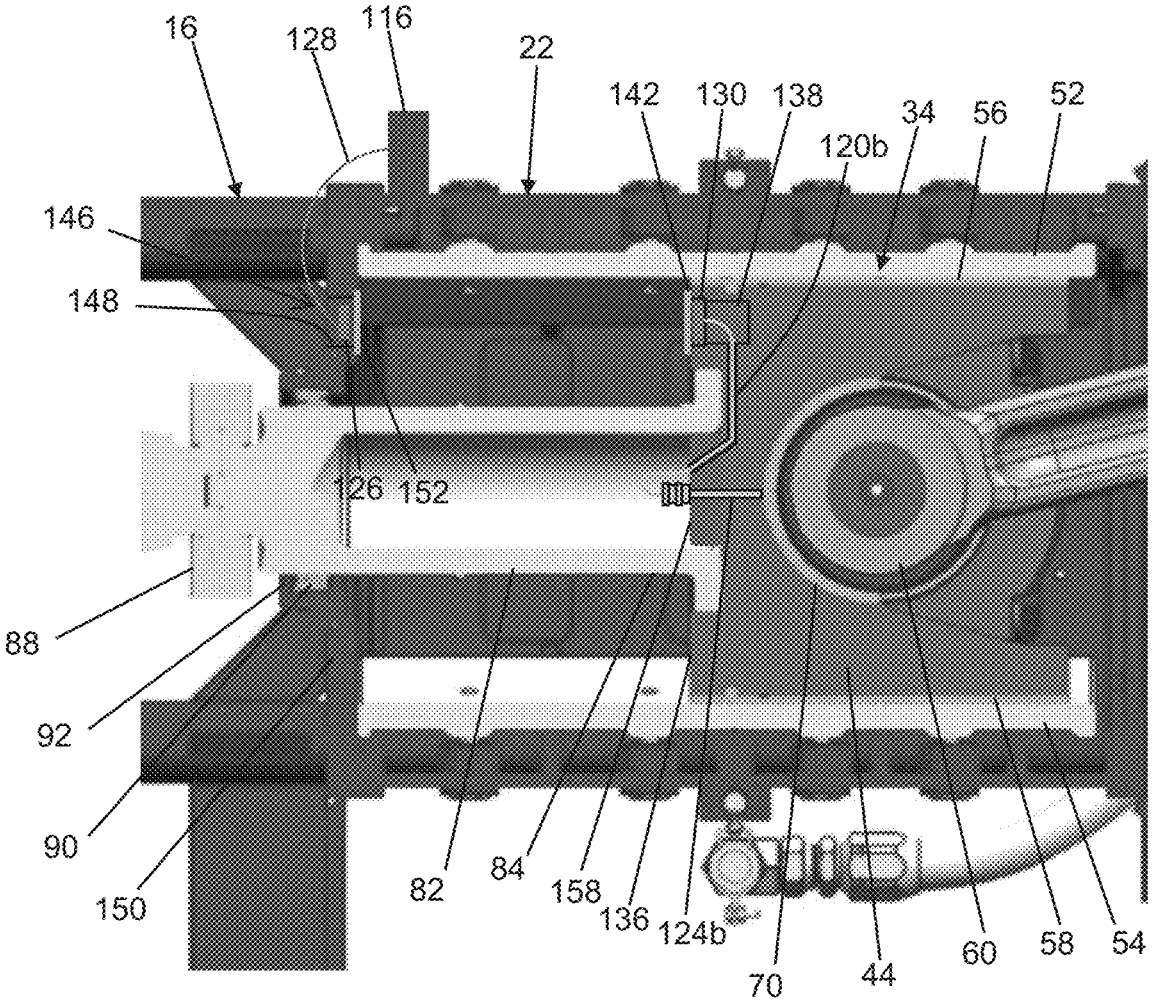
FIG. 10 is an enlarged view of a portion of FIG. 2 showing the crosshead and surrounding components of the present disclosure.
Figure 11:
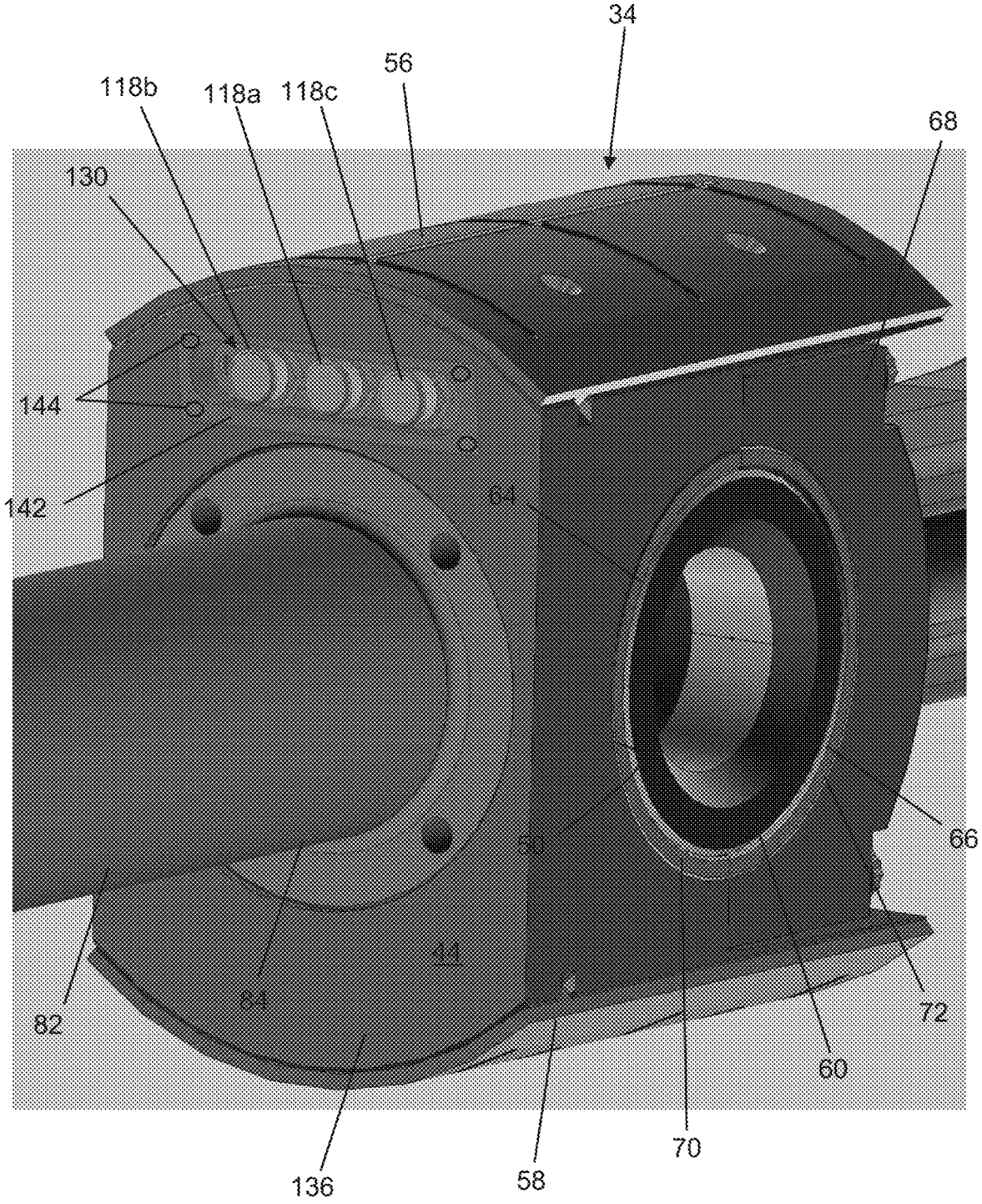
FIG. 11 is an enlarged view of a portion of FIG. 3 showing the crosshead component of the present disclosure.
Figure 12:
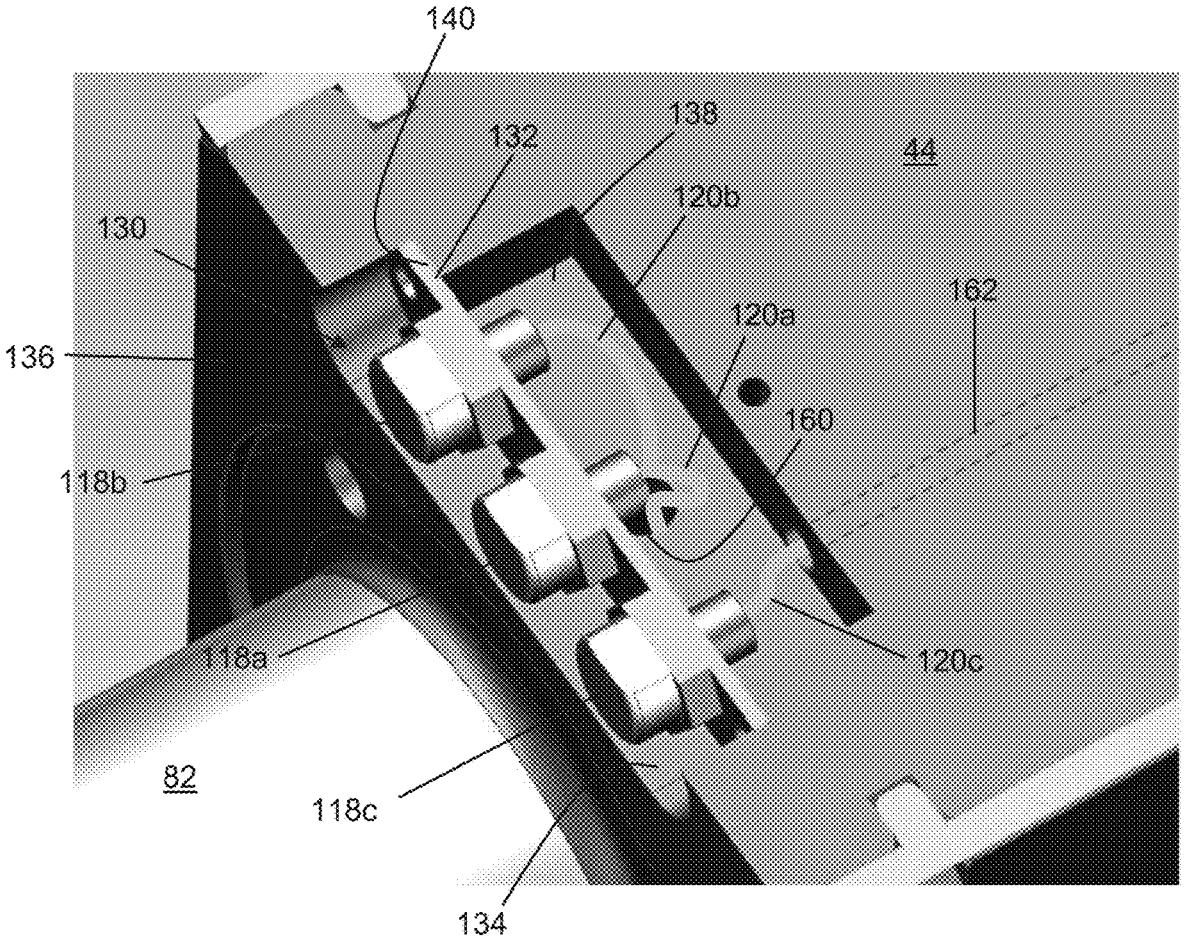
FIG. 12 is a perspective, horizontal cross sectional view of a portion of the crosshead component of the present disclosure.

Each plunger 32 may be connected to its respective crosshead 34 by a pony shaft 82. The pony shaft 82 includes a first end 84 which is secured to the crosshead 34 and a second end 86 which is releasably coupled to the plunger 32 using a split collar connector 88. Referring also to FIGS. 9 and 10, each pony shaft 82 extends through a corresponding hole in the crank housing 22 and is sealed thereto using a suitable pony shaft seal 90 mounted in a collar 92 which is secured to the crank housing 22 over the hole.

Figure 6:
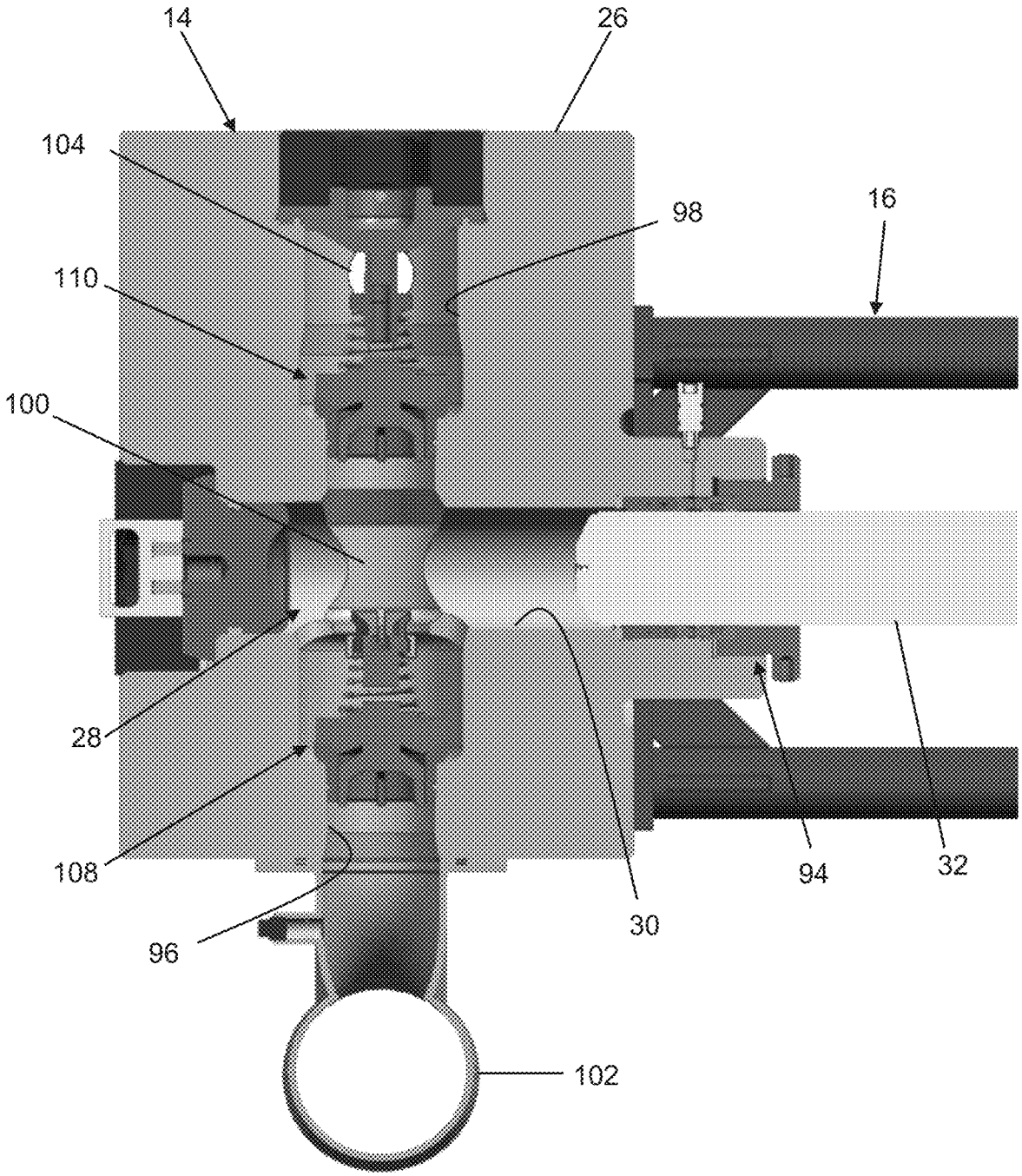
FIG. 6 is a transverse cross sectional view of the fluid end assembly of the plunger pump shown in FIGS. 1 and 2.
Figure 7:
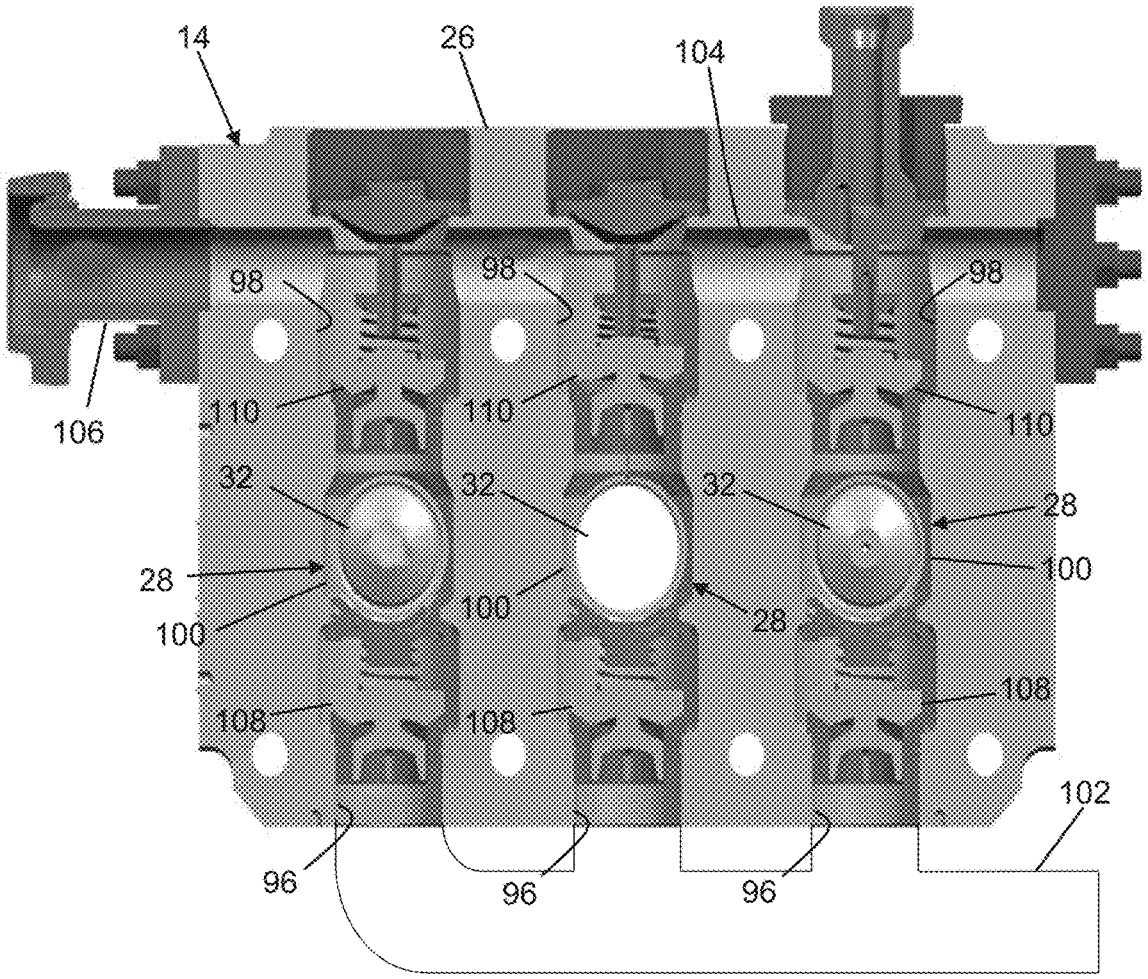
FIG. 7 is a longitudinal cross sectional view of the fluid end assembly shown in FIG. 6.

Referring also to FIGS. 6 and 7, the end of the plunger 32 opposite the pony shaft 82 is slidably received in the plunger bore 30 and is sealed thereto using a conventional stuffing box 94. Within the fluid end housing 26, each plunger bore 30 is connected to both a suction bore 96 and a discharge bore 98 via a cross bore 100. Each suction bore 96 is connected to a common suction line, which in one embodiment of the disclosure is configured as a suction manifold 102 extending beneath the fluid end housing 26. Similarly, each discharge bore 98 is connected to a common discharge line, which in the particular example shown in the drawings is configured as an elongated bore extending laterally through the fluid end housing 26 to a discharge fitting 106. A suction valve 108 mounted in the suction bore 96 permits fluid flow from the suction manifold 102 to the cross bore 100 but prevents fluid flow in the opposite direction. Likewise, a discharge valve 110 mounted in the discharge bore 98 permits fluid flow from the cross bore 100 to the outlet bore 104 but prevents fluid flow in the opposite direction.

In normal operation of the pump 10, fluid enters the suction bore 96 through the suction manifold 102 and flows through the suction valve 108 and into the cross bore 100. As the plunger 32 advances into the crossbore 100, the fluid is pressurized. As the pressure of the fluid in the crossbore 100 reaches the pressure in the discharge line 104, the discharge valve 110 opens and allows the fluid to flow through the discharge bore 98 and into the discharge line. Once the plunger 32 reaches its full stroke, it retreats and causes the pressure in the crossbore 100 to drop. This allows the discharge valve 110 to close and the suction valve 108 to open, once again filling the crossbore 100 with fluid from the suction manifold 102. As each plunger 32 is driven by rotation of the crankshaft (through its respective connecting rod 36, crosshead 34 and pony shaft 82), this advancing/retreating cycle is repeated to create a continuous flow of fluid from the suction manifold 102 through the discharge line 104 and out the discharge fitting 106.

As discussed above, during operation of high powered reciprocating pumps, such as those used in the well service industry, some of the power end components may be subject to failure, and it is important for potential failures to be detected before they actually occur in order to prevent a breakdown of the entire pump. In accordance with the present disclosure, therefore, a monitoring system is provided for monitoring the condition of the wear components of the power end of the pump. The condition of the wear components is monitored by measuring the temperatures of the power end bearings. This enables the specific bearings to be replaced, or other remedial actions to be taken, prior to reaching a temperature at which the failure of the bearings is imminent. Thus, rather than relying on indirect measurements of the condition of the power end bearings, which can only indicate that a failure has already occurred, the monitoring system of the present disclosure provides information from which a potential failure can be predicted so that remedial action can be taken prior to a total failure of the power end.

Figure 8:
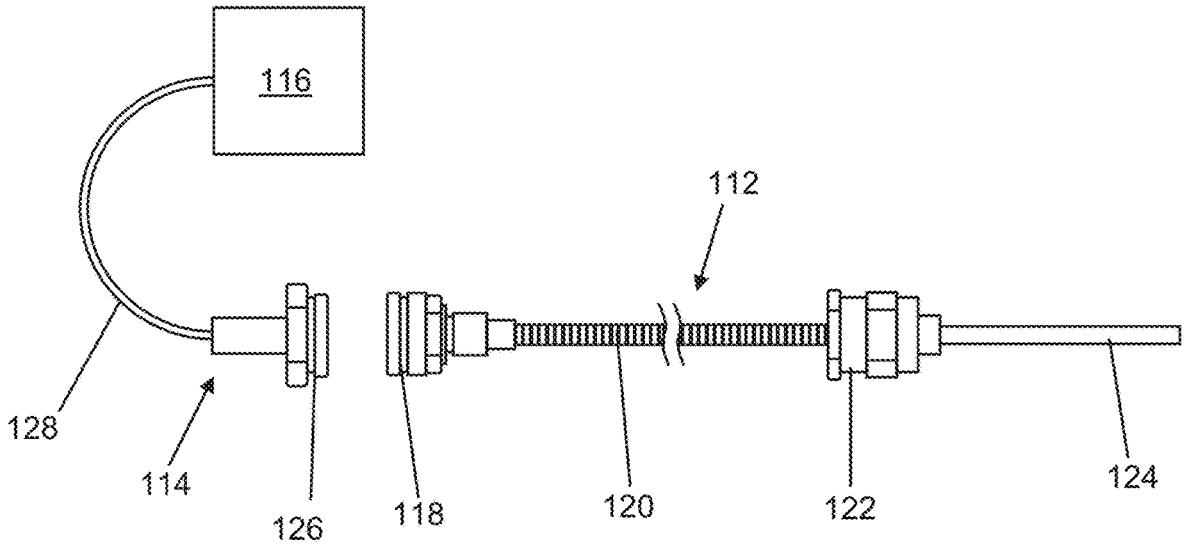
FIG. 8 is a schematic representation of one embodiment of the wireless temperature monitoring system which can be incorporated into the plunger pump of the present disclosure.

In accordance with one embodiment of the disclosure, the power end monitoring system is designed to monitor the temperature of the power end bearings using a wireless temperature monitoring system, such as the Sentry GB-200 wireless temperature monitoring system sold by Kongsberg Maritime AS of Trondheim, Norway. Referring to FIG. 8, the wireless temperature monitoring system includes a wireless temperature sensor 112, an antenna 114 and a signal processing unit 116. In this embodiment, the temperature sensor 112 includes a sensor head 118 which is connected via a flexible shaft 120 and a connector 122 to a temperature probe 124. Also, the antenna 114 includes an antenna head 126 which is connected to the signal processing unit 116 via a coaxial cable 128. In applications requiring more than a single temperature sensor 112 and antenna 114, the temperature monitoring system may comprise multiple sensor/antenna pairs 112/114 (each of which comprises a temperature sensor 112 and a corresponding antenna 114). In addition, two or more sensor/antenna pairs 112/114 may be connected to the same signal processing unit 116.

In operation, the heat generated by the component to be measured is conducted through the probe 124 and the flexible shaft 120 to the sensor head 118. Periodically, the signal processing unit 116 generates a low energy, high frequency radar pulse which is transmitted by the antenna head 126 toward the sensor head 118. This radar pulse is reflected by the sensor head 118, and the reflected pulse is received by the antenna head 126 and conducted via the cable 128 back to the signal processing unit 116. The signal processing unit 116 then determines the temperature of the component from the shape and characteristics of the reflected pulse, which are directly related to the temperature of the sensor head 118. When the sensor probe is positioned in contact with a component, therefore, the temperature of the sensor head is indicative of the temperature of the component.

In accordance with one embodiment of the present disclosure, the temperature monitoring system is used to measure the temperatures of the lower crosshead slides 58, the wrist pin bearings 70 and the crank pin bearings 78 (although it may also be used to monitor the temperatures of different or additional components as well). The advantage of employing the temperature monitoring system described above to measure the temperatures of these components is that, since the sensor head 118 and the antenna head 126 of each sensor/antenna pair 112/114 communicate wirelessly, the temperature sensor 112 does not require a direct physical connection to its corresponding antenna 114. Thus, the temperature sensors 112 can be mounted on the moving crosshead and connecting rod assemblies while their corresponding antennas 114 and the signal processing unit 116 can be mounted on a fixed part of the pump 10, such as the crank housing 22.

In the present embodiment, the pump 10 may be provided with three sensor/antenna pairs 112/114 for each crosshead and connecting rod assembly, one each to monitor the temperature of the lower crosshead slide 58, the wrist pin bearing 70 and the crank bearing 78. Although the temperature probes 124 will be distributed through the crosshead and connecting rod assembly so as to be in direct contact with the components being monitored, the sensor heads 118 for each crosshead and connecting rod assembly may, in one embodiment, be incorporated into a single sensor head assembly.

Referring to FIGS. 3 and 10-12, for instance, the three individual sensor heads 118*a*, 118*b*, 118*c* for each crosshead and connecting rod assembly may be incorporated into a single sensor head assembly 130 which is mounted to, e.g., the body 44 of the crosshead 34. As shown best in FIG. 12, the sensor heads 118*a*, 118*b*, 118*c* may be secured to an elongated bracket 132 which in turn is connected to the body 44. In one example, the sensor head assembly 130 may be positioned in a recess 134 which is formed in the front face 136 of the body 44. In addition, the crosshead 34 may also include a cavity 138 formed in the body 44 behind the recess 134 (the purpose of which will be made apparent below), and each end of the bracket 132 may be secured to a corresponding shoulder 140 which is defined between the cavity and the recess. As shown best in FIG. 11, a suitable cover 142 may be secured (and, if required, sealed) to the front face 136 of the crosshead body 44 (such as by screws 144) over the recess 134 in order to isolate the sensor head assembly 130 from the surrounding harsh environment. The cover 142 may be made of a material which is transparent to the radar pulses, i.e., a material which will not interfere with the radar pulses communicated between the sensor heads 118 and their corresponding the antenna heads 126.

Referring in particular to FIGS. 9 and 10, the three antenna heads 126 for each crosshead and connecting rod assembly may be incorporated into a single antenna head assembly 146 which is mounted to a fixed portion of the pump 10. Although the antenna head assembly 146 is shown schematically in the figures, it may be similar to the sensor head assembly 130. The position of the antenna head assembly 146 is chosen so that, during each stroke of the crosshead 34, the sensor head assembly 130 will be brought sufficiently close to the antenna head assembly to enable the transmission of radar pulses between the antenna heads 126 and their corresponding sensor heads 118. For example, the antenna head assembly 146 may be mounted in a corresponding opening 148 in the front wall 150 of the crank housing 22 which is located opposite the sensor head assembly 130 when the crosshead 134 is fully retracted. As with the sensor head assembly 130, the opening 146 may be closed and sealed by a suitable cover 152 (FIG. 10) which is secured by suitable means to the interior of the front wall 150 of the crank housing 22.

As an alternative to the arrangement just described, each antenna 114 may be mounted separately in the front wall 150 of the crank housing 22 (or in another suitable part of the pump 10). In this example, each antenna 114 would be mounted in a corresponding hole using a suitable cable gland connector.

Referring still to FIGS. 9 and 10, the three antenna heads 126 of each crosshead and connecting rod assembly may be connected individually via a respective cable 128 to a single signal processing unit 116 mounted, e.g., on the top surface of the crank housing 22. According to this embodiment, therefore, a single signal processing unit 116 may be provided for each crosshead and connecting rod assembly (as shown in FIG. 1). In an alternative embodiment, however, a single signal processing unit 116 may be provided for the antennas 114 of all three crosshead and connecting rod assemblies. In either case, the temperature measurements made by the signal processing unit or units 116 may be transmitted, either wirelessly or via signal cables, to a central monitoring station 154 (such as show, e.g., in FIG. 1), which can be configured to track the temperatures of the components and provide a warning when the temperature of a component is approaching a predetermined temperature limit for that component. As an alternative to this arrangement, the signal processing unit or units 116 may be configured to provide such a warning, such as by providing a visual or audible signal or sending a suitable message to the central monitoring station 154.

Figure 13:
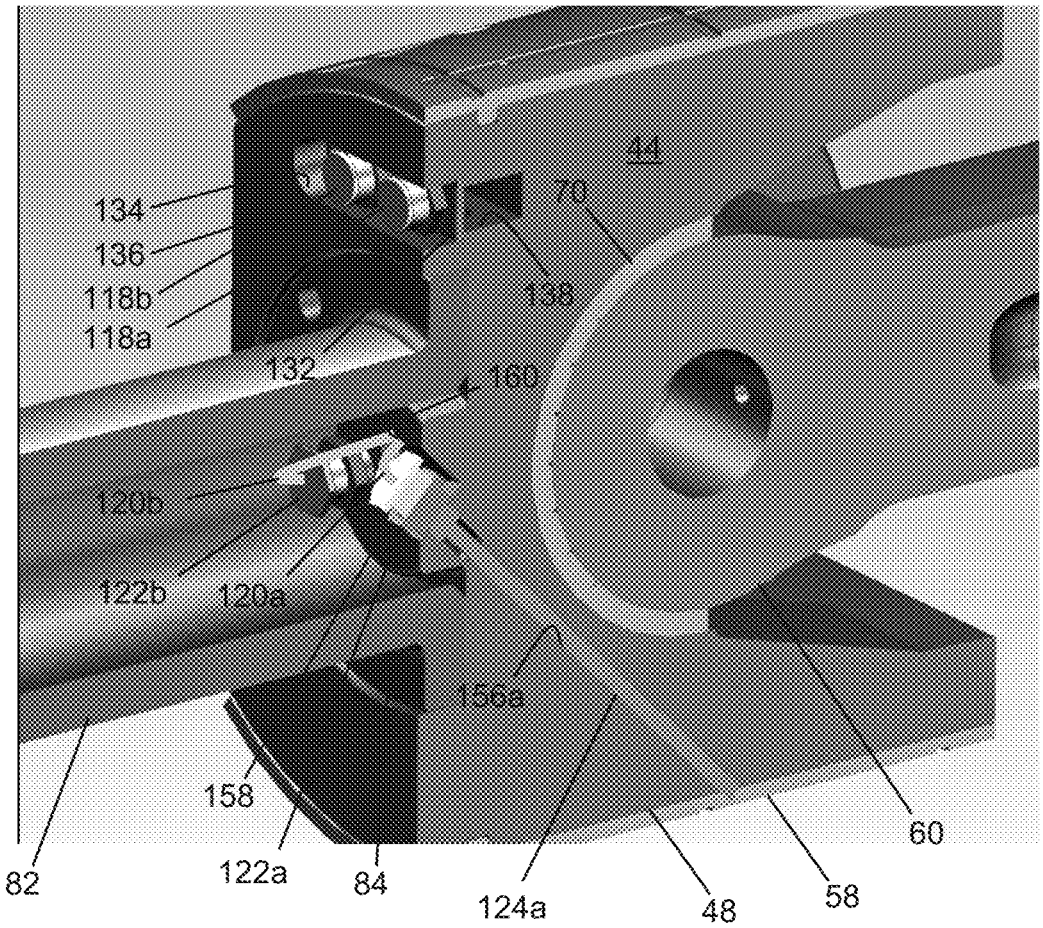
FIGS. 13-15 are perspective, vertical cross sectional views of a portion of the crosshead component of the present disclosure taken at different vertical sections.

Referring to FIGS. 12-16, certain examples of the positioning of the temperature probes 124 and the connection of the probes to the sensor heads 118 will now be described. As shown in FIG. 13, the temperature probe 124*a* for the lower crosshead slide 58 is mounted in a corresponding drilling 156*a* which extends from the bottom surface 48 of the crosshead body 44 to, in this example, a portion 158 of the front face 136 of the crosshead body which is surrounded by the first end 84 of the pony shaft 82. The connector 122*a* which connects the probe 124*a* to the flexible shaft 120*a* may be secured in a threaded counterbore at the upper or proximal end of the drilling 156*a*. From the connector 122*a*, the flexible shaft 120*a* is threaded through a bore 160 which extends through the crosshead body to the cavity 138 (see FIG. 15), where it is connected to its corresponding sensor head 118*a* (see FIG. 12).

Figure 14:
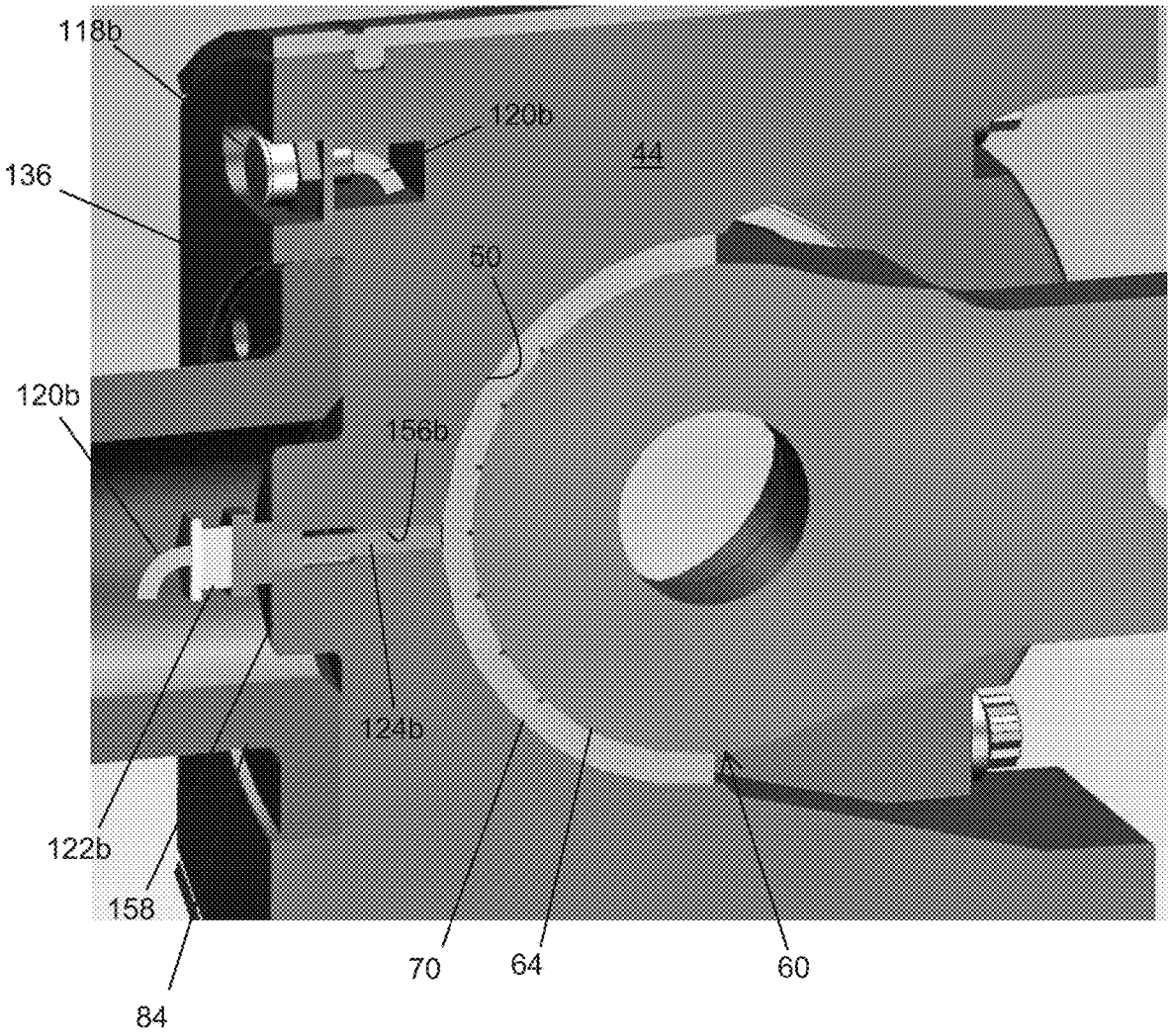
Figure 15:
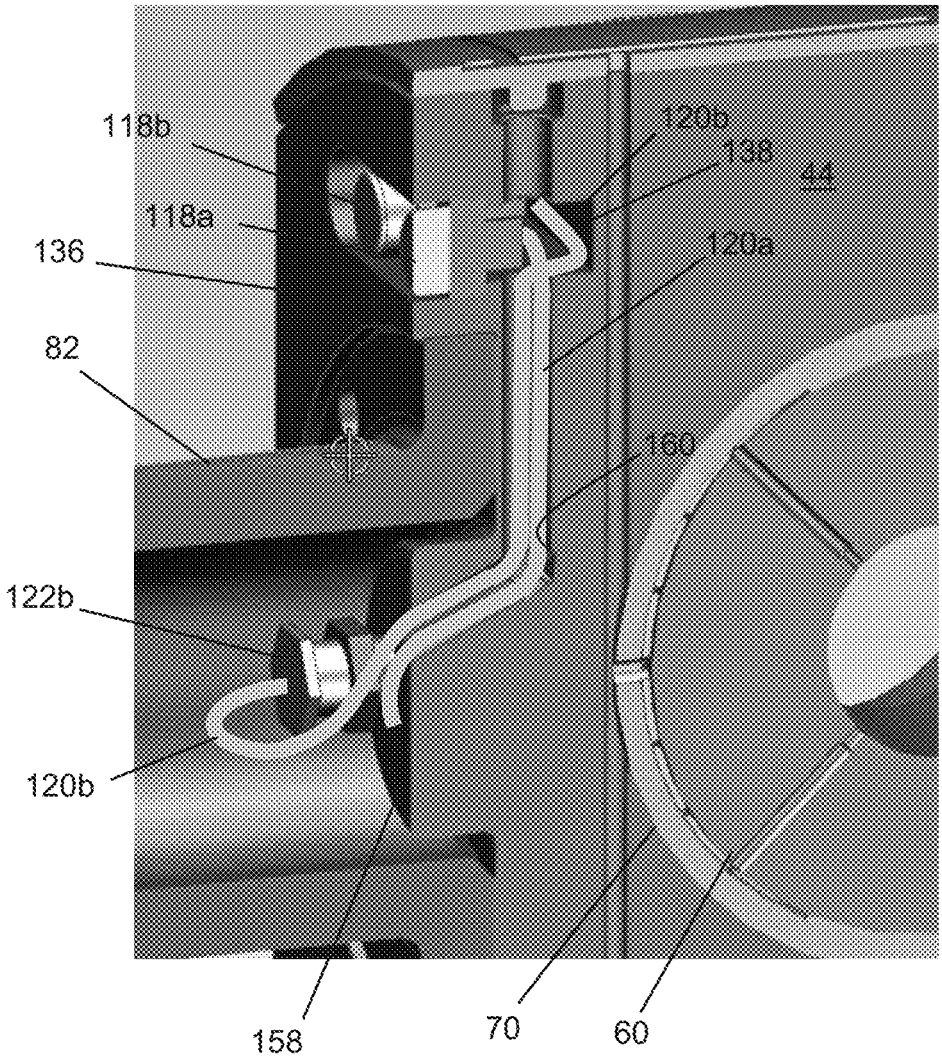

As shown in FIG. 14, the temperature probe 124*b* for the wrist pin bearing 70 may be mounted in a corresponding drilling 156*b* which extends from the semi-cylindrical recess 50 in the crosshead body 14 to the portion 158 of the front face 136 of the crosshead body which is surrounded by the first end 84 of the pony shaft 82. The connector 122*b* which connects the probe 124*b* to the flexible shaft 120*b* may be secured in a threaded counterbore at the proximal end of the drilling 156*b*. As shown in FIG. 15, from the connector 122*b* the flexible shaft 120*b* may be routed through the bore 160 (together with the flexible shaft 120*a*) to the cavity 138, where it is connected to its corresponding sensor head 118*b* (see FIG. 12). This positioning of the temperature probe 124*b* and its connection to the sensor head 118*b* via the flexible shaft 120*b* is also shown in FIG. 10.

In this particular example, positioning the temperature probe 124*b* in contact with the wrist pin bearing 70 is particularly advantageous. Since the wrist pin bearing 70 will typically experience greater loads during the pump cycle than the trunnion bearing 72, a greater amount of frictional heat will usually be generated in the wrist pin bearing 70. This in turn will cause the temperature of the wrist pin bearing 70 to rise faster and higher than the temperature of the trunnion bearing 72. Thus, by positioning the temperature probe 124*b* in contact with the wrist pin bearing 70, a potential failure of both bearings can be averted. In contrast, if the temperature probe 124*b* were to be positioned in contact with the trunnion bearing 72, the wrist pin bearing 70 may already have failed by the time the temperature of the trunnion bearing 72 reaches the level at which a failure of the trunnion bearing is imminent.

Figure 16:
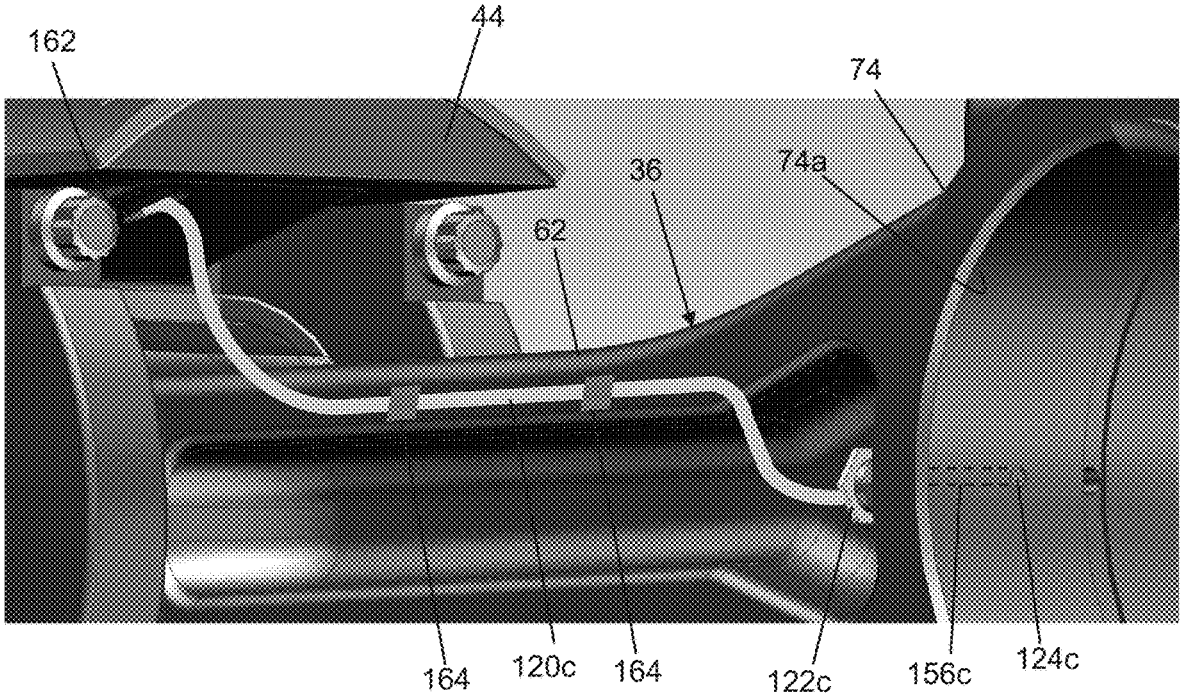
FIG. 16 is a rear perspective view of a portion of the crosshead and connecting rod assembly of the present disclosure.

As shown in FIG. 16, the temperature probe 124*c* for the crank pin bearing 78 (only the distal tip of which is visible) may be mounted in a drilling 156*c* (shown in phantom) which extends from the inner surface 74*a* of the first collar half 74 to an outer surface portion of the first collar half which is located adjacent the shaft 62 (see also FIG. 3). The connector 122*c* which connects the probe 124*c* to the flexible shaft 120*c* may be secured in a threaded counterbore at the proximal end of the drilling 156*c*. From the connector 122*c*, the flexible shaft 120*b* may be routed along the shaft 62 and through a corresponding bore 162 extending from the rear of the crosshead body 44 to the cavity 138 (see FIG. 12, in which the bore 162 is shown in phantom), where it is connected to its corresponding sensor head 118*c*. If desired, the flexible shaft 120*c* may be secured to the shaft 62 using, e.g., one or more clips 164.

In this embodiment of the disclosure, positioning the temperature probe 124*c* in contact with the first crank pin bearing 78 (in the first collar half 74) is particularly beneficial. Since the first crank pin bearing 78 will typically experience greater loads during the pump cycle than the second crank pin bearing 80 (in the second collar half 76), a greater amount of frictional heat will usually be generated in the first crank pin bearing 78. This in turn will cause the temperature of the first crank pin bearing 78 to rise faster and higher than the temperature of the second crank pin bearing 80. Thus, by positioning the temperature probe 124*c* in contact with the first crank pin bearing 78, a potential failure of both crank pin bearings can be averted. In contrast, if the temperature probe 124*c* were to be positioned in contact with the second crank pin bearing 80, the first crank pin bearing 78 may already have failed by the time the temperature of the second crank pin bearing 80 reaches the level at which a failure of that bearing is imminent.

The mounting of the components of the temperature monitoring system as just described offers several advantages. By grouping the sensor heads 118 together in a single sensor head assembly 130, the sensors can be conveniently located and easily installed in the crosshead body 44. Also, by positioning the sensor head assembly 130 in the recess 134, the sensor heads 118 will not interfere with the other components of the power end assembly during operation of the pump. In addition, the connections between the flexible shafts 120 and the sensor heads 118 can be made up in a single convenient location, namely, the cavity 136. Furthermore, by positioning the connectors 122 within the end of the pony shaft 82, the connectors will be protected from the harsh environment of the fluid end.

Thus, it may be seen that the power end monitoring system relies on the direct measurement of the temperatures of certain power end bearings (such as the crosshead slides, the wrist pin bearing and the crank pin bearing) to provide an indication of the conditions of the bearings. Should the temperature of any of these bearings approach certain predetermined limits, the power end monitoring system can provide a warning so that the issue can be addressed before the bearings fail, thereby enabling more severe damage to the other power end components to be prevented.

As discussed above, a failure of the suction or discharge valves could over time lead to failure of larger, more expensive components of the pump. For example, a failed discharge valve causes what the industry refers to as "constant rod load". The pump relies on the cyclic rod load, specifically the low rod load, to create an opportunity for lubricant to inject into the areas that see the highest rod loads, such as the crosshead slides and the wrist pin and crank pin bearings. Without these moments of low loads, the wear surfaces will not receive lubricant, and as a result they will overheat. This can cause the more expensive pump parts (such as the crankshaft, the connecting rod and the crosshead) to overheat and catastrophically fail.

In accordance with an embodiment of the present disclosure, therefore, the pump may be provided with a system for monitoring the functionality of the suction and discharge valves. This system may be incorporated into the pump without the power end monitoring system just described. If the pump should incorporate both monitoring systems, the valve monitoring system may be a standalone system, or it may be combined with the power end monitoring system into a single pump condition monitoring system.

The valve monitoring system of one embodiment of the disclosure relies on monitoring the axial load acting on the plunger 32 during each cycle of the pump. One parameter used to represent this axial load is "rod load". The rod load of a pump is the load on the plunger which is transmitted through all of the components back to the crankshaft and in turn back to the drive line The rod load is directly proportional to the pressure in the crossbore 100 and the diameter of the plunger 32 and may accordingly be represented as follows:

$$\text{Rod Load (lbf)} = \frac{\text{Crossbore Pressure (psi)} * \text{Plunger } OD^2 \text{ (in)}}{4}$$

Figure 17:
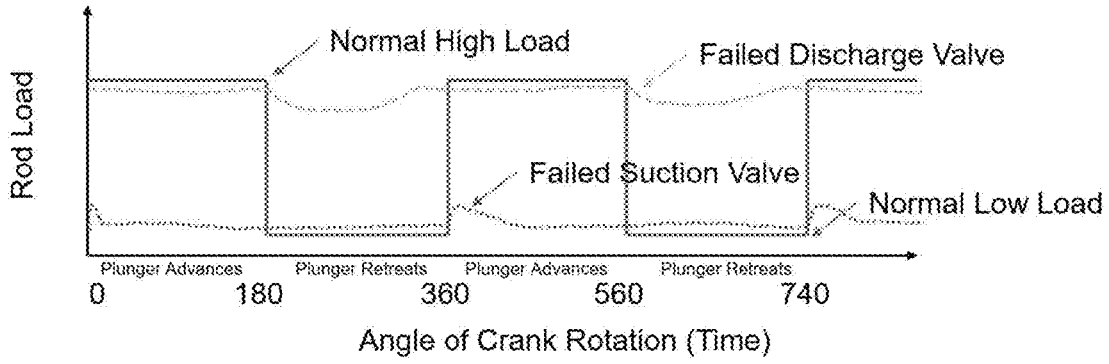
FIG. 17 is a graph showing the relationship between rod load and angle of crankshaft rotation of a plunger pump.

In normal operations, the rod load is high while the plunger advances and low while the plunger retreats. This relationship is represented in FIG. 17, which is a graph of rod load versus angle of crankshaft rotation. When the discharge valve fails, the cross bore will be in communication with the discharge line both when the plunger advances and retreats. As shown in FIG. 17, the result of this is that the rod load will remain high through the entire cycle and will never reach the "normal low load" value.

When the suction valve fails, the suction line will be in communication with the crossbore as the plunger both advances and retreats. Instead of overcoming the discharge line pressure to open the discharge valve, the fluid will return into the suction line. As shown in FIG. 17, the result of this is that the rod load will remain low through the entire cycle and will never reach the "normal high load" value.

The valve monitoring system in accordance with one embodiment of the present disclosure relies on these principles to monitor the functionality of the suction and discharge valves during operation of the pump. In particular, in one embodiment of the disclosure the valve monitoring system includes means for measuring the rod load throughout the pump cycle and comparing the measured rod load values to the normal rod load values, that is, the rod load values obtained during normal operation of the pump (such as shown, e.g., in FIG. 17) in order to determine whether a suction valve or a discharge valve has failed. Even without determining the exact rod load, during normal operation the rod load will alternate between high and low values through the full pump cycle. If the rod load remains high throughout the cycle, this would indicate that the discharge valve is failing to seal and that the crankshaft is not experiencing the low rod load it needs to properly lubricate the bearings. If the rod load remains low throughout the cycle, this would indicate that the suction valve is failing to seal and high pressure is being allowed to communicate to the low pressure lines. High pressure in the low pressure lines can cause failure in numerous components upstream of the pump.

Figure 18:
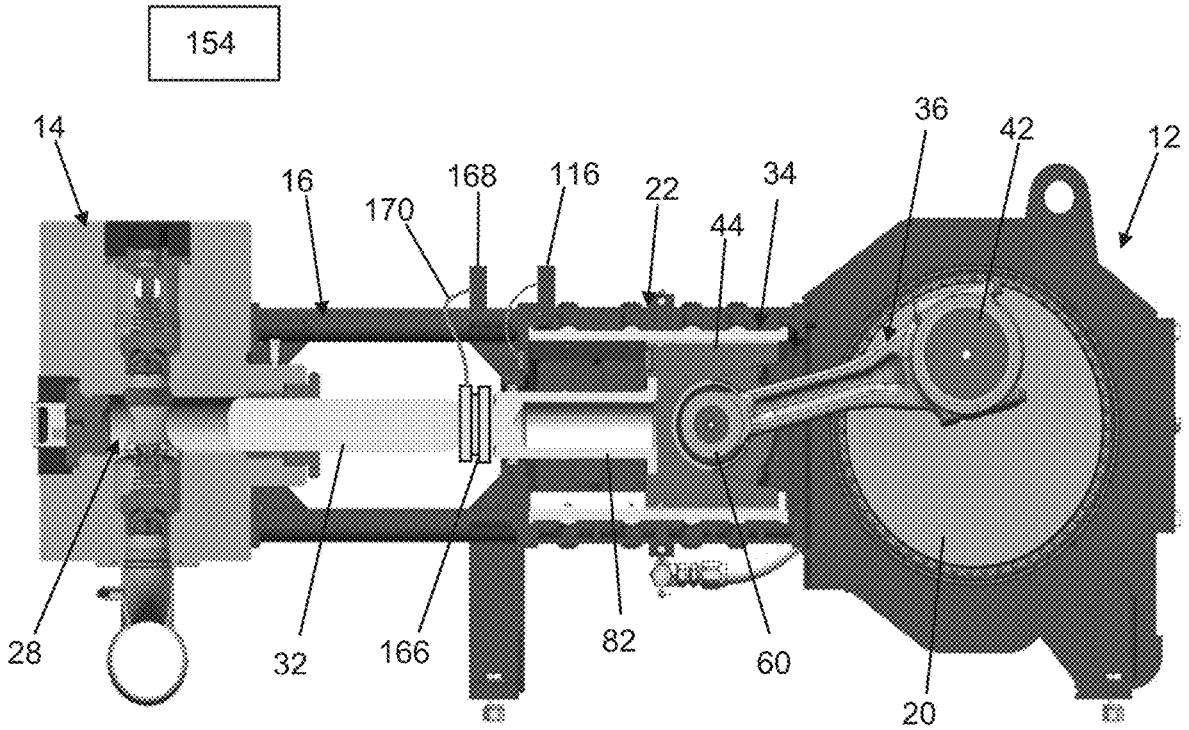
FIG. 18 is a longitudinal cross sectional view of a plunger pump which includes another embodiment of the condition monitoring system of the present disclosure.

Referring to FIG. 18, the valve monitoring system of one embodiment of the present disclosure includes a rod load sensor 166 which is positioned in the rod load bearing path and is configured to generate signals indicative of the rod load on the plunger 32. For purposes of the present disclosure, the rod load bearing path may be considered to comprise the plunger 32 itself and all of the components in the drive train between the plunger and the input shaft of the pump 10, such as the crankshaft 20, the wrist pin 42, the connecting rod 36, the crosshead 34, the pony shaft 82 (if present), and any device which is positioned between and/or used to connect adjacent ones of these components together. In embodiments in which the pump includes a plurality of plungers 32, the valve monitoring system may include a respective rod load sensor for each of any number of the plungers. The signals from the rod load sensor 166 are communicated to a signal processing unit 168 which is configured to determine from the measured rod load values whether the suction valve or the discharge valve has failed. For example, the signal processing unit 168 may be configured to compare the measured rod load values to the normal high and low rod load values (stored, e.g., in a suitable memory accessible to the signal processing unit) and, if the measured rod load values deviate from the normal rod load values in the manner described above, to provide an indication that the suction valve or the discharge valve has failed.

In the illustrative embodiment of the valve monitoring system is shown in FIG. 18, the rod load sensor 166 comprises a force sensor 166 which is configured to measure the axial load on the plunger 32. In embodiments in which the pump comprises a plurality of plungers 32, the valve monitoring system may comprise a corresponding number of force sensors 166, one for each plunger. In this embodiment, each force sensor 166 may be linked to a respective signal processing unit 168, or all of the force sensors may be linked to a common signal processing unit. The signal processing unit or units 168 may be mounted, e.g., on the crank housing 22, and the force sensors 166 may communicate with their respective signal processing units 168 either wirelessly or through a signal cable 170.

The force sensor 166 may be mounted anywhere in the rod load bearing path where the rod load can be measured. In the embodiment of FIG. 18, for instance, the force sensor 166 is mounted between the pony shaft 82 and the plunger 32. However, the force sensor 166 could be mounted in other locations, such as between the pony shaft 82 and the crosshead body 44. The force sensor 166 could also be made an integral part of the plunger 32, the pony shaft 83, the connecting rod 36, the crankshaft 20, the crank pin 42, or any component between the plunger 32 and the input shaft of the pump.

A suitable force sensor 166 for use in the present disclosure, particularly in embodiments in which the force sensor 166 is mounted between the pony shaft 82 and the plunger 32 or between the pony shaft and the crosshead body 44, may comprise a washer style load sensor, such as the LWPF2 high capacity press force load washer load cell sold by Interface, Inc. of Scottsdale, Arizona, or a pancake style load sensor, such as the LCHD load cell sold by Omega Engineering Inc. of Norwalk, Connecticut In other embodiments, the rod load sensor 166 may comprise any sensor which is configured to measure the deformation of a component in the rod load bearing path. For example, the rod load sensor 166 may comprise a linear variable differential transformer (LVDT). In this embodiment, the LVDT sensor 166 could be mounted to the pony shaft 82 (e.g., internally of the pony shaft) to measure the change in length of the pony shaft during operation of the pump. Alternatively, the LVDT sensor 166 could be mounted to the connecting rod 36 to measure the change in length of the connecting rod during operation of the pump. A suitable LVDT for use in these applications is the model LD620-5 LVDT linear position sensor sold by Omega Engineering Inc. of Norwalk, Connecticut In still other embodiments, the rod load can be determined by measuring stress/strain on a component in the rod load bearing path. For example, a suitable strain gauge could be mounted to the connecting rod 36, the pony shaft 82, or any other component in the rod load bearing path.

During operation of the valve monitoring system, the rod load sensor 166 will measure the rod load at a plurality of instances throughout the pump cycle. The signal processing unit 168 will then compare the measured rod load values to the normal high and low rod load values for the pump cycle (as represented, e.g., in FIG. 17). If the signal processing unit 168 determines that the measured rod load values are near the normal high rod load value during the entire pump cycle, the signal processing unit will provide an indication that the discharge valve has failed. Likewise, if the signal processing unit 168 determines that the measured rod load values are near the normal low rod load value during the entire pump cycle, the signal processing unit will provide an indication that the suction valve has failed.

As with the power end monitoring system described above, the signal processing unit 168 may be linked with the central monitoring station 154, which can be configured to provide a visual or audible signal or send a suitable message if a failure of a suction valve or discharge valve should occur. As an alternative to this arrangement, the output of the rod load sensors 166 may be transmitted directly to the central monitoring station 154, which can be configured to determine, using the method described above, if a suction valve or a discharge valve has failed.

In an alternative embodiment, the rod load sensor 166 may be linked to a simplified signal processing unit 168 comprising a visual indicator, such as an LED display, which can be configured to provide a suitable indication of whether a suction or discharge valve has failed. For example, the LED display may be configured to flash red if the rod load is over a certain value (e.g., 5,000 psi) and to flash green if the rod load is under that value. In this example, the LED display may be configured to flicker between red and green to indicate normal operation (meaning that the measured rod loads are alternating between the normal high and normal low values). In addition, the LED display may be configured to generate a continuous red light (meaning that the rod load is remaining near the normal high value) to indicate that a discharge valve has failed, and to generate a continuous green light (meaning that the rod load is remaining near the normal low value) to indicate that a suction valve has failed.

Thus, it may be seen that the valve monitoring system of the present disclosure relies on the measurement of rod load to provide an indication of failure of a suction or discharge valve. The rod load can be measured by a rod load sensor mounted in the power end of the pump, such as between the pony shaft and the plunger. Thus, the valve monitoring system does not require the use of pressure sensors in the fluid end to monitor the condition of the suction and discharge valves. As a result, the fluid end does not need to be provided with potentially problematic mounting holes for the pressure sensors. In addition, should the fluid end need replacing, the valve monitoring system can remain in place on the power end, thereby eliminating the need to reinstall pressure sensors on the new fluid end.

It should be recognized that, while the present disclosure has been described in relation to certain embodiments thereof, those skilled in the art may develop a wide variation of structural and operational details without departing from the principles of the disclosure. For example, the various elements shown in the different embodiments may be combined in a manner not described above. Therefore, the following claims are to be construed to cover all equivalents falling within the true scope and spirit of the disclosure.

What is claimed is:

1. A reciprocating pump comprising:

a power end assembly having a crankshaft rotationally supported therein;

a fluid end assembly having at least one plunger bore in communication with a suction line and a discharge line, a suction valve positioned between the plunger bore and the suction line, and a discharge valve positioned between the plunger bore and the discharge line;

a plunger slidably supported in the plunger bore;

a connecting rod having a first end rotationally connected to a crank pin on the crankshaft and a second end configured as a wrist pin, the first end being configured as a split collar having a first collar half connected to the wrist pin by an elongated shaft and a second collar half connected to the first collar half over the crank pin;

a crosshead having a first face to which the plunger is connected and an opposite second face comprising a crosshead recess in which the wrist pin is pivotably received, the crosshead being slidably supported between first and second elongated crosshead guide surfaces such that rotation of the crankshaft results in linear reciprocating motion of the crosshead and, thus, the plunger;

first and second crosshead bearings, each of which is positioned between the crosshead and a corresponding one of the first and second crosshead guide surfaces;

a wrist pin bearing positioned between the wrist pin and the crosshead recess;

a crank pin bearing positioned between the crank pin and the first collar half; and a system for monitoring the temperature of at least one of the first and second crosshead bearings and at least one of the wrist pin bearing and the crank pin bearing, the system comprising:

a plurality of wireless temperature sensors, each of which includes a temperature probe connected to a sensor head;

a plurality of antennas, each of which comprises an antenna head configured to communicate wirelessly with a corresponding one of the sensor heads;

a signal processing unit connected to the plurality of antennas;

wherein each of the temperature probes is positioned in contact with a corresponding one of said monitored bearings;

wherein each sensor head is mounted to the crosshead;

wherein each antenna head is mounted to the pump at a location in which communication is enabled between the antenna head and its corresponding sensor head when the crosshead reaches a first position during each reciprocation of the crosshead; and wherein in operation of the temperature monitoring system each antenna head transmits a radar pulse which is reflected by its corresponding sensor head, wherein the reflected pulse is received by the antenna head and communicated to the signal processing unit, and wherein the signal processing unit determines the temperature of the sensor head from the reflected pulse;

whereby the temperature of each sensor head is indicative of the temperature of its corresponding monitored bearing.

2. The pump of claim 1, wherein the sensor heads are mounted on the first face of the crosshead.

3. The pump of claim 1, wherein the sensor heads are mounted in a recess formed in the first face of the crosshead.

4. The pump of claim 3, further comprising a cover which is connected to the crosshead over the recess and is transparent to the radar pulses.

5. The pump of claim 1, wherein the plunger is connected to the first face of the crosshead by an elongated pony shaft, wherein each temperature sensor comprises a flexible shaft having a first end connected to the sensor head and a second end connected to the temperature probe using a connector, and wherein a number of the temperature sensors are arranged in the crosshead such that their corresponding connectors are surrounded by an end of the pony shaft which is connected to the first face of the crosshead.

6. The pump of claim 5, wherein the sensor heads are mounted in a recess formed in the first face of the crosshead, and wherein the flexible shaft for each of said number of the temperature sensors is routed from its corresponding connector through a bore in the crosshead which is connected to the recess.

7. The pump of claim 1, further comprising a valve monitoring system for monitoring the condition of at least one of the suction valve and the discharge valve, the valve monitoring system comprising:

a rod load sensor which is positioned in a rod load bearing path of the pump and is configured to measure a rod load value on the plunger a number of times during each cycle of the pump; and a signal processing unit which is configured to compare the measured rod load values to normal high and low rod load values and, if the measured rod load values deviate from the normal rod load values, to provide an indication that the suction valve or the discharge valve has failed.

8. The pump of claim 7, wherein the rod load sensor is positioned between the wrist pin and the connecting rod, or between the connecting rod and the crosshead or between the crosshead and the plunger.

9. The pump of claim 7, wherein the plunger is connected to the first face of the crosshead by an elongated pony shaft, and wherein the rod load sensor is positioned between the plunger and the pony shaft.

10. The pump of claim 8 or 9, wherein the rod load sensor comprises a load cell.

11. The pump of claim 7, wherein the rod load sensor is mounted to the connecting rod, or the crosshead or the plunger.

12. The pump of claim 7, wherein the plunger is connected to the first face of the crosshead by an elongated pony shaft, and wherein the rod load sensor is mounted to the pony shaft.

13. The pump of claim 11 or 12, wherein the rod load sensor comprises a linear variable differential transformer (LVDT).

14. A method for monitoring a condition of a reciprocating pump, the pump comprising:

a power end assembly having a crankshaft rotationally supported therein;

a fluid end assembly having at least one plunger bore in communication with a suction line and a discharge line, a suction valve positioned between the plunger bore and the suction line, and a discharge valve positioned between the plunger bore and the discharge line;

a plunger slidably supported in the plunger bore;

a connecting rod having a first end rotationally connected to a crank pin on the crankshaft and a second end configured as a cylindrical wrist pin, the first end being configured as a split collar having a first collar half connected to the wrist pin by an elongated shaft and a second collar half connected to the first collar half over the crank pin;

a crosshead having a first face to which the plunger is connected and an opposite second face comprising a crosshead recess in which the wrist pin is pivotably received, the crosshead being slidably supported between first and second elongated crosshead guide surfaces such that rotation of the crankshaft results in linear reciprocating motion of the crosshead and, thus, the plunger; and first and second crosshead bearings, each of which is positioned between the crosshead and a corresponding one of the first and second crosshead guide surfaces, a wrist pin bearing positioned between the wrist pin and the crosshead recess, and a crank pin bearing positioned between the crank pin and the first collar half;

wherein the method comprises:

providing a plurality of wireless temperature sensors, each of which includes a temperature probe connected to a sensor head;

providing a plurality of antennas, each of which includes an antenna head configured to communicate wirelessly with a corresponding one of the sensor heads;

positioning a first of said temperature probes in contact with the first crosshead bearing or the second crosshead bearing, and positioning a second of said temperature probes in contact with the wrist pin bearing or the crank pin bearing;

mounting each sensor head to the crosshead;

mounting each antenna head to the pump at a location in which communication is enabled between the antenna head and its corresponding sensor head when the crosshead reaches a first position during each reciprocation of the crosshead;

transmitting a radar pulse from each antenna head towards its corresponding sensor head;

reflecting the radar pulse received at each sensor head back to its corresponding antenna head;

determining from each reflected radar pulse the temperature of the corresponding sensor head;

whereby the temperature of each sensor head is indicative of the temperature of the bearing its corresponding temperature probe is positioned against.

15. The method of claim 14, further comprising mounting the sensor heads on the first face of the crosshead.

16. The method of claim 14, further comprising mounting the sensor heads in a recess formed in the first face of the crosshead.

17. The method of claim 16, further comprising covering the recess with a cover which is transparent to the radar pulses.

18. The method of claim 14, wherein the plunger is connected to the first face of the crosshead by an elongated pony shaft, wherein each temperature sensor comprises a flexible shaft having a first end connected to the sensor head and a second end connected to the temperature probe using a connector, and wherein the method further comprises arranging a number of the temperature sensors in the crosshead such that their corresponding connectors are surrounded by an end of the pony shaft which is connected to the first face of the crosshead.

19. The method of claim 18, wherein the sensor heads are mounted in a recess formed in the first face of the crosshead, and wherein the method further comprises routing the flexible shaft for each of said number of the temperature sensors from its corresponding connector through a bore in the crosshead which is connected to the recess.

20. A reciprocating pump comprising:

a power end assembly having a crankshaft rotationally supported therein;

a fluid end assembly having at least one plunger bore in communication with a suction line and a discharge line, a suction valve positioned between the plunger bore and the suction line, and a discharge valve positioned between the plunger bore and the discharge line;

a plunger slidably supported in the plunger bore;

a connecting rod having a first end rotationally connected to a crank pin on the crankshaft and a second end configured as a wrist pin;

a crosshead having a first face to which the plunger is connected and an opposite second face comprising a crosshead recess in which the wrist pin is pivotably received, the crosshead being slidably supported in the pump such that rotation of the crankshaft results in linear reciprocating motion of the crosshead and, thus, the plunger; and a valve monitoring system for monitoring the condition of at least one of the suction valve and the discharge valve, the valve monitoring system comprising:

a rod load sensor which is positioned in a rod load bearing path of the pump and is configured to measure a rod load value on the plunger a number of times during each cycle of the pump; and a signal processing unit which is configured to compare the measured rod load values to normal high and low rod load values and, if the measured rod load values deviate from the normal rod load values, to provide an indication that the suction valve or the discharge valve has failed;

wherein the signal processing unit does not use measured values of a suction pressure in the fluid end assembly or a discharge pressure in the fluid end assembly to determine whether the measured rod load values deviate from the normal rod load values.

21. The pump of claim 20, wherein the rod load sensor is positioned between the wrist pin and the connecting rod, or between the connecting rod and the crosshead or between the crosshead and the plunger.

22. The pump of claim 20, wherein the plunger is connected to the first face of the crosshead by an elongated pony shaft, and wherein the rod load sensor is positioned between the plunger and the pony shaft.

23. The pump of claim 21 or 22, wherein the rod load sensor comprises a load cell.

24. The pump of claim 20, wherein the rod load sensor is mounted to the connecting rod, or the crosshead or the plunger.

25. The pump of claim 20, wherein the plunger is connected to the first face of the crosshead by an elongated pony shaft, and wherein the rod load sensor is mounted to the pony shaft.

26. The pump of claim 24 or 25, wherein the rod load sensor comprises a linear variable differential transformer (LVDT).

27. The pump of claim 20, wherein the first end of the connecting rod is configured as a split collar having a first collar half connected to the wrist pin by an elongated shaft and a second collar half connected to the first collar half over the crank pin, wherein the crosshead is slidably supported between first and second elongated crosshead guide surfaces, and wherein the pump further comprises:

first and second crosshead bearings, each of which is positioned between the crosshead and a corresponding one of the first and second crosshead guide surfaces;

a wrist pin bearing positioned between the wrist pin and the crosshead recess;

a crank pin bearing positioned between the crank pin and the first collar half; and a system for monitoring the temperature of at least one of the first and second crosshead bearings and at least one of the wrist pin bearing and the crank pin bearing, the system comprising:

a plurality of wireless temperature sensors, each of which includes a temperature probe connected to a sensor head;

a plurality of antennas, each of which comprises an antenna head configured to communicate wirelessly with a corresponding one of the sensor heads;

a signal processing unit connected to the plurality of antennas;

wherein each of the temperature probes is positioned in contact with a corresponding one of said monitored bearings;

wherein each sensor head is mounted to the crosshead;

wherein each antenna head is mounted to the pump at a location in which communication is enabled between the antenna head and its corresponding sensor head when the crosshead reaches a first position during each reciprocation of the crosshead; and wherein in operation of the temperature monitoring system each antenna head transmits a radar pulse which is reflected by its corresponding sensor head, wherein the reflected pulse is received by the antenna head and communicated to the signal processing unit, and wherein the signal processing unit determines the temperature of the sensor head from the reflected pulse;

whereby the temperature of each sensor head is indicative of the temperature of its corresponding monitored bearing.

28. The pump of claim 27, wherein the sensor heads are mounted on the first face of the crosshead.

29. The pump of claim 27, wherein the sensor heads are mounted in a recess formed in the first face of the crosshead.

30. The pump of claim 29, further comprising a cover which is connected to the crosshead over the recess and is transparent to the radar pulses.

31. The pump of claim 27, wherein the plunger is connected to the first face of the crosshead by an elongated pony shaft, wherein each temperature sensor comprises a flexible shaft having a first end connected to the sensor head and a second end connected to the temperature probe using a connector, and wherein a number of the temperature sensors are arranged in the crosshead such that their corresponding connectors are surrounded by an end of the pony shaft which is connected to the first face of the crosshead.

32. The pump of claim 31, wherein the sensor heads are mounted in a recess formed in the first face of the crosshead, and wherein the flexible shaft for each of said number of the temperature sensors is routed from its corresponding connector through a bore in the crosshead which is connected to the recess.

33. A method for monitoring the condition of a suction valve or a discharge valve in a reciprocating pump, the pump comprising:

a power end assembly having a crankshaft rotationally supported therein;

a fluid end assembly having at least one plunger bore in communication with a suction line and a discharge line, the suction valve being positioned between the plunger bore and the suction line and the discharge valve being positioned between the plunger bore and the discharge line;

a plunger slidably supported in the plunger bore;

a connecting rod having a first end rotationally connected to a crank pin on the crankshaft and a second end configured as a wrist pin; and a crosshead having a first face to which the plunger is connected and an opposite second face comprising a crosshead recess in which the wrist pin is pivotably received, the crosshead being slidably supported in the pump such that rotation of the crankshaft results in linear reciprocating motion of the crosshead and, thus, the plunger;

wherein the method comprises:

positioning a rod load sensor in a rod load bearing path of the pump;

using the rod load sensor, measuring the rod load value on the plunger a number of times during each cycle of the pump; and determining whether the measured rod load values deviate from normal high and low rod load values; and if the measured rod load values deviate from the normal rod load values, providing an indication that the suction valve or the discharge valve has failed;

wherein the step of determining whether the measured rod load values deviate from the normal rod load values does not rely on measured values of a suction pressure in the fluid end assembly or a discharge pressure in the fluid end assembly.

34. The method of claim 33, wherein the step of positioning the rod load sensor in the rod load bearing path comprises positioning the rod load sensor between the wrist pin and the connecting rod, or between the connecting rod and the crosshead or between the crosshead and the plunger.

35. The method of claim 33, wherein the plunger is connected to the first face of the crosshead by an elongated pony shaft, and wherein the step of positioning the rod load sensor in the rod load bearing path comprises positioning the rod load sensor between the plunger and the pony shaft.

36. The method of claim 33, wherein the step of positioning the rod load sensor in the rod load bearing path comprises mounting the rod load sensor to the connecting rod, or the crosshead or the plunger.

37. The method of claim 33, wherein the plunger is connected to the first face of the crosshead by an elongated pony shaft, and wherein the step of positioning the rod load sensor in the rod load bearing path comprises mounting the rod load sensor to the pony shaft.

* * * * *